US006560422B2

(12) United States Patent
Kanno et al.

(10) Patent No.: US 6,560,422 B2
(45) Date of Patent: May 6, 2003

(54) DEVELOPMENT CARTRIDGE, PROCESS CARTRIDGE, AND ELECTROPHOTOGRAPHIC IMAGE FORMING APPARATUS, AND TONER SEAL MEMBER FOR UNSEALING AN OPENING FOR SUPPLYING DEVELOPER BY AUTOMATICALLY WINDING UP THE TONER SEAL MEMBER

(75) Inventors: Kazuhiko Kanno, Odawara (JP); Tatsuya Shiratori, Yokohama (JP); Kouji Hashimoto, Shizuoka-ken (JP); Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/888,604

(22) Filed: Jun. 26, 2001

(65) Prior Publication Data

US 2002/0018668 A1 Feb. 14, 2002

(30) Foreign Application Priority Data

Jun. 26, 2000 (JP) ..... 2000-190857

(51) Int. Cl.[7] ..... G03G 15/08
(52) U.S. Cl. ..... 399/106; 399/258
(58) Field of Search ..... 399/13, 27, 102, 399/103, 106, 258, 262

(56) References Cited

U.S. PATENT DOCUMENTS

| | | | | | |
|---|---|---|---|---|---|
| 5,142,335 | A | * | 8/1992 | Sakata et al. | 399/106 |
| 5,729,796 | A | | 3/1998 | Miura et al. | 399/114 |
| 5,740,500 | A | | 4/1998 | Hashimoto | 399/114 |
| 5,745,822 | A | * | 4/1998 | Nishimura et al. | 399/106 |
| 5,815,644 | A | | 9/1998 | Nishiuwatoko et al. | 399/113 |
| 5,870,655 | A | | 2/1999 | Nishiuwatoko et al. | 399/111 |
| 5,893,006 | A | | 4/1999 | Kanno et al. | 399/13 |
| 5,903,803 | A | | 5/1999 | Kawai et al. | 399/116 |
| 5,923,924 | A | | 7/1999 | Hashimoto | 399/111 |
| 5,926,666 | A | | 7/1999 | Miura et al. | 399/25 |
| 5,937,240 | A | | 8/1999 | Kanno et al. | 399/111 |
| 5,940,657 | A | | 8/1999 | Yokomori et al. | 399/119 |
| 5,950,049 | A | | 9/1999 | Yokomori et al. | 399/119 |
| 6,016,408 | A | | 1/2000 | Hashimoto et al. | 399/27 |
| 6,044,235 | A | | 3/2000 | Hashimoto | 399/99 |
| 6,055,406 | A | | 4/2000 | Kawai et al. | 399/360 |
| 6,070,029 | A | | 5/2000 | Nishiuwatoko et al. | 399/111 |
| 6,072,969 | A | | 6/2000 | Yokomori et al. | 399/119 |
| 6,101,352 | A | | 8/2000 | Hashimoto et al. | 399/119 |
| 6,115,567 | A | | 9/2000 | Kawai et al. | 399/106 |
| 6,122,458 | A | * | 9/2000 | Kita et al. | 399/27 |
| 6,128,454 | A | | 10/2000 | Kawai et al. | 399/116 |
| 6,151,459 | A | | 11/2000 | Hashimoto et al. | 399/27 |
| 6,163,665 | A | | 12/2000 | Watanabe et al. | 399/111 |
| 6,175,706 | B1 | | 1/2001 | Watanabe et al. | 399/167 |
| 6,178,302 | B1 | | 1/2001 | Nagashima et al. | 399/106 |
| 6,226,478 | B1 | | 5/2001 | Watanabe et al. | 399/117 |
| 6,240,266 | B1 | | 5/2001 | Watanabe et al. | 399/117 |
| 6,246,853 | B1 | | 6/2001 | Suzuki et al. | 399/262 |
| 6,301,457 | B1 | * | 10/2001 | Chadani et al. | 399/106 X |

* cited by examiner

*Primary Examiner*—William J. Royer
(74) *Attorney, Agent, or Firm*—Fitzpatrick, Cella, Harper & Scinto

(57) ABSTRACT

A toner seal member to be used for sealing a developer container including a developer accommodating portion for accommodating a developer; and an opening for supplying the developer from the developer accommodating portion, the toner seal member being for sealing the opening, wherein the toner seal member unseals the opening by being automatically wound up, the toner seal member including a sealing portion for covering and sealing the opening; and a regulating portion for regulating an operation of a detecting member for detecting winding-up of the toner seal member to unseal the opening.

17 Claims, 19 Drawing Sheets

DEVELOPMENT CARTRIDGE, PROCESS CARTRIDGE, AND ELECTROPHOTOGRAPHIC IMAGE FORMING APPARATUS, AND TONER SEAL MEMBER FOR UNSEALING AN OPENING FOR SUPPLYING DEVELOPER BY AUTOMATICALLY WINDING UP THE TONER SEAL MEMBER

FIELD OF THE INVENTION AND RELATED ART

The present invention relates to a toner seal member, a developing cartridge, a process cartridge, and an electrophotographic image forming apparatus to which said process cartridge is detachably mountable. The electrophotographic image forming apparatus forms an image on a recording material through an electrophotographic image-formation-type process. Examples of the electrophotographic image forming apparatus include an electrophotographic copying machine, an electrophotographic printer (a laser beam printer or LED printer), a facsimile machine, a word processor and the like. The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Furthermore, the process cartridge may contain at least the electrophotographic photosensitive drum and the developing means. The present invention is applicable to a process cartridge having such developing means.

Heretofore, in an electrophotographic image forming apparatus using the electrophotographic image process, a process-cartridge-type apparatus, in which the electrophotographic photosensitive member and process means actable on the electrophotographic photosensitive member are integrally contained in a cartridge, is detachably mountable to the main assembly of the image forming apparatus.

Such a process cartridge contains a photosensitive drum, and developing means is used to apply developer (toner) to a latent image formed on the photosensitive drum. In the developing means, a developing device frame supporting a developing roller for feeding the toner to the photosensitive drum and a toner frame (toner container) accommodating the toner, are coupled with each other. Before the start of use of the process cartridge, an opening provided in a connecting portion between the toner frame and the developing device frame is sealed by a seal member. A process cartridge equipped with an automatic toner seal removing device for automatically unsealing the opening of the toner frame when the process cartridge is mounted to the main assembly of the image forming apparatus, and an image forming apparatus which is capable of driving the automatic toner seal winding device, are known. In addition, a developing cartridge is also known, which is integrally provided with developing means and a toner container accommodating the toner to be supplied to the developing means, in which an opening through which the toner is supplied to the developing means from the toner container is sealed. Further, a developing cartridge is provided with an automatic toner-seal removing device.

The present invention provides a further development of such devices.

SUMMARY OF THE INVENTION

Accordingly, it is a principal object of the present invention to provide a toner seal member, a developing cartridge, a process cartridge and an electrophotographic image forming apparatus in which a toner seal can be automatically wound up. It is another object of the present invention to provide a toner seal member, a developing cartridge, a process cartridge and an electrophotographic image forming apparatus in which the toner seal member can be smoothly wound up.

It is a further object of the present invention to provide a toner seal member for producing an automatic toner-seal removing device in which the winding-up of the toner seal member is assuredly detected, and the driving of a winding shaft is finally stopped and by which an outermost part of the wound-up toner seal member flaps and/or the excessive load in a driving source can be avoided, but also to provide a development cartridge and a process cartridge on which the toner seal member is removably affixed, and an electrophotographic image forming apparatus to which said process cartridge is detachably mountable.

According to an aspect of the present invention, there is provided a toner seal member to be used for sealing a developer container including a developer accommodating portion for accommodating a developer; and an opening for supplying the developer from the developer accommodating portion, the toner seal member being for sealing the opening, wherein the toner seal member unseals the opening by being automatically wound up, the toner seal member including a sealing portion for covering and sealing the opening. There is also provided a regulating portion for regulating an operation of a detecting member for detecting winding-up of the toner seal member to unseal the opening.

According to another aspect of the present invention, there is provided a development cartridge and a process cartridge using a toner seal member, and an image forming apparatus with which the toner seal member, the development cartridge, and the process cartridge are usable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Next, an embodiment of a development cartridge in accordance with the present invention, and an electrophotographic image forming apparatus which employs such a development cartridge, will be described.

Embodiment 1

First, referring to FIGS. 1–14, the general structure of an image forming apparatus in accordance with the present invention will be described.

First, referring to FIG. 1, the general structure of a color image forming apparatus will be described.

Figure 1:
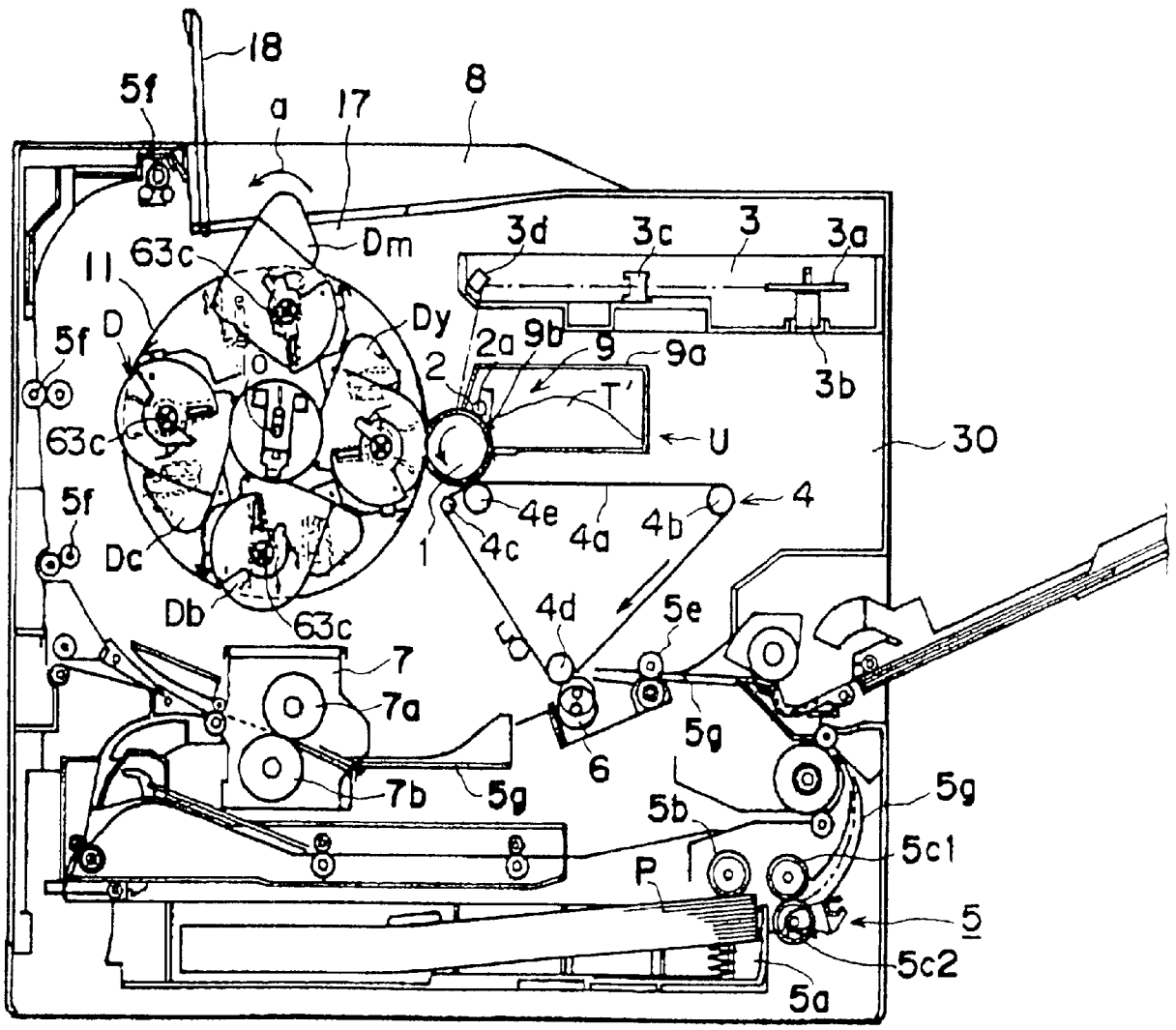
FIG. 1 is a sectional view of a main assembly of an image forming apparatus including a developing cartridge, according to the present invention.

FIG. 1 is a vertical sectional view of a laser printer, a form of a color image forming apparatus, for describing the general structure thereof The color laser printer comprises: a process cartridge U in which a photosensitive drum 1, which rotates at a constant velocity, is supported; an image forming portion comprising four rotatable development cartridges D; and an intermediary transfer member 4 which holds color images as the color images are developed in the image forming portion and transferred onto the intermediary transfer member 4, and then transfers the color images onto a transfer medium P delivered to the intermediary transfer member 4 by a conveying means 5.

The transfer medium P onto which the color images have been just transferred is conveyed to a fixing portion, in which the color images are fixed to the transfer medium P. Thereafter, the transfer medium P is discharged by a discharge roller 5*f* into a delivery portion 8 located at the top of the apparatus. The rotatable development cartridges D are structured so that they can be individually mounted into or dismounted from the main assembly 30 of the printer.

Next, the structures of various components and portions of the image forming apparatus will be described detail.

The process cartridge U has a photosensitive drum 1, and a cleaning means 9, a residual toner containing portion 9*a*, which is an integral part of the process cartridge U and doubles as the holder for the photosensitive drum 1. It is removably supported by the main assembly 30 so that the process cartridge U, which is currently in the main assembly 30, can be easily replaced with a new process cartridge in accordance with the service life of the photosensitive drum 1.

The photosensitive drum 1 in this embodiment comprises an aluminum cylinder with a diameter of approximately 50 mm, and an organic photoconductor layer coated on the peripheral surface of the aluminum cylinder. The photosensitive drum 1 is rotationally supported by the residual toner container 9*a*, which doubles as the holder for photosensitive drum 1. In the areas adjacent the peripheral surface of the photosensitive drum 1, a cleaning blade 9*b* for removing the developer (toner) remaining on the peripheral surface of the photosensitive drum 1, and a primary charging means 2 for uniformly charging the peripheral surface of the photosensitive drum 1, are disposed. The photosensitive drum 1 is rotated in the counterclockwise direction, as shown in the drawing, in synchronism with an image forming operation, by transmitting a driving force from an unshown motor to one end of the photosensitive drum 1, that is, the end on the rear side of the drawing.

The charging means 2 in this embodiment employs a contact charging method, and comprises an electrical charge roller 2*a*, which is placed in contact with the photosensitive drum 1. The peripheral surface of the photosensitive drum 1 is uniformly charged by applying a voltage to the charge roller 2*a* placed in contact with the peripheral surface of the photosensitive drum 1.

The exposing of the photosensitive drum 1 is carried out by a scanner portion 3. More specifically, as image signals are given to a laser diode, the laser diode emits image light modulated with the image signals, at a polygon mirror 3*a*.

The polygon mirror 3*a* is rotated at a high velocity by a scanner motor 3*b*. While the polygon mirror 3*a* is rotated at a high velocity, the image light is reflected by the polygon mirror 3*a*, passes through a focusing lens 3*c*, is deflected by a reflection mirror 3*d*, and is projected onto the peripheral surface of the photosensitive drum 1, which is being rotated at a predetermined constant velocity, selectively exposing the peripheral surface of the photosensitive drum 1. As a result, an electrostatic latent image is formed on the peripheral surface of the photosensitive drum 1.

The developing means is provided with four development cartridges Dy, Dm, Dc and Db, which are capable of visualizing, that is, developing, an electrostatic latent image in yellow, magenta, cyan, and black colors, correspondingly.

Figure 2:
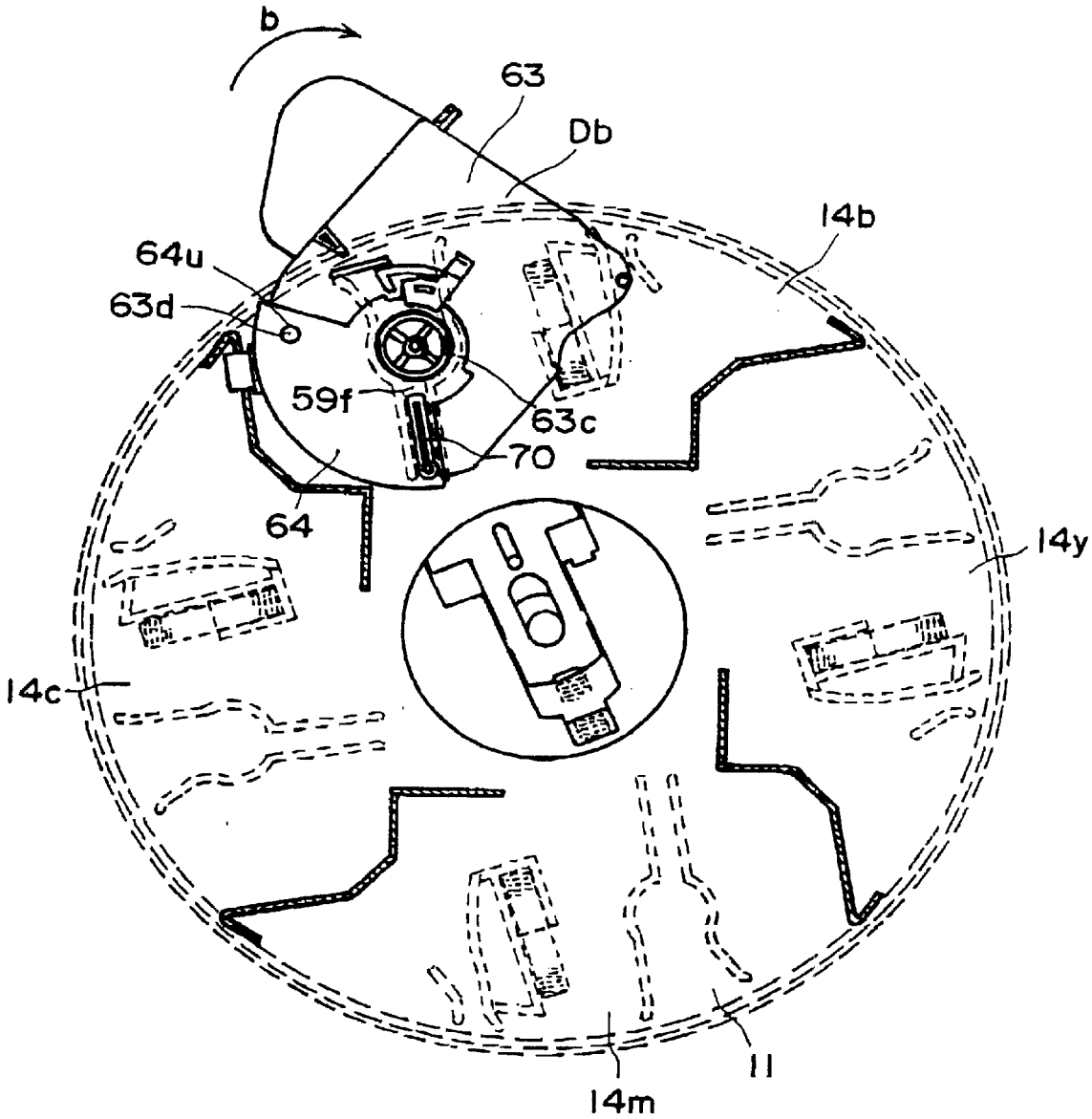
FIG. 2 is a front view of a rotary unit used in an embodiment of the present invention.
Figure 3:
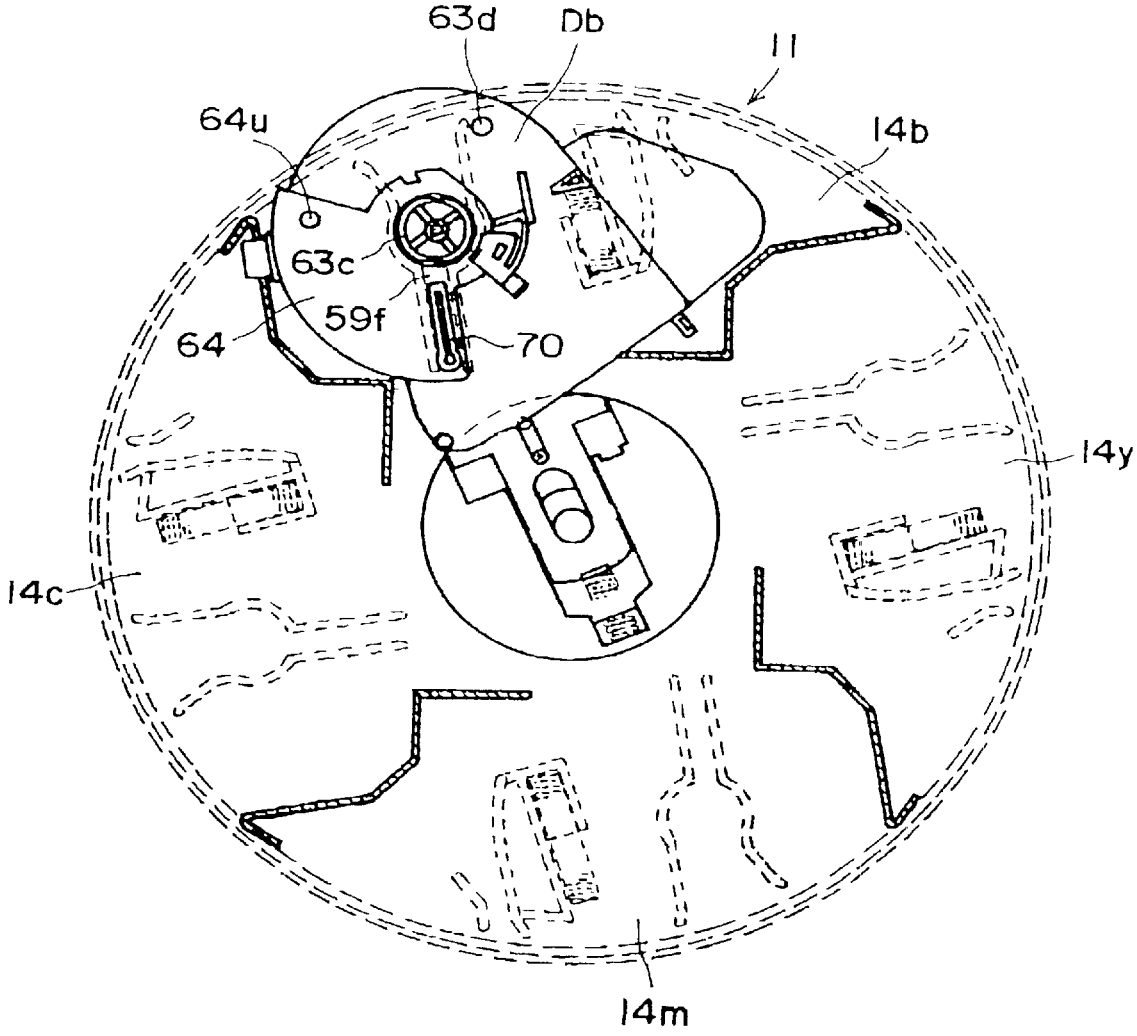
FIG. 3 is a front view of the rotary unit used in an embodiment of the present invention.

Referring to FIGS. 1–3, each of the four development cartridges D is removably held by a rotary unit 11 and enabled to rotate about a shaft 10. In an image forming operation, each development cartridge D is moved by the rotation of rotary unit 11 to a predetermined position, at which development roller 12, which will be described later, opposes the photosensitive drum 1, holding a microscopic gap (approximately 300 $\mu$m) from the photosensitive drum 1, and forms a visible image which reflects the electrostatic latent image, on the photosensitive drum 1.

In a color image forming operation, each time the intermediary transfer member 4 rotates once, the rotary unit 11 also rotates once, moving the yellow development cartridge Dy, magenta development cartridge Dm, cyan development cartridge Dc, and black development cartridge Db, in this order, to the above described predetermined position to carry out development processes.

Figure 4:
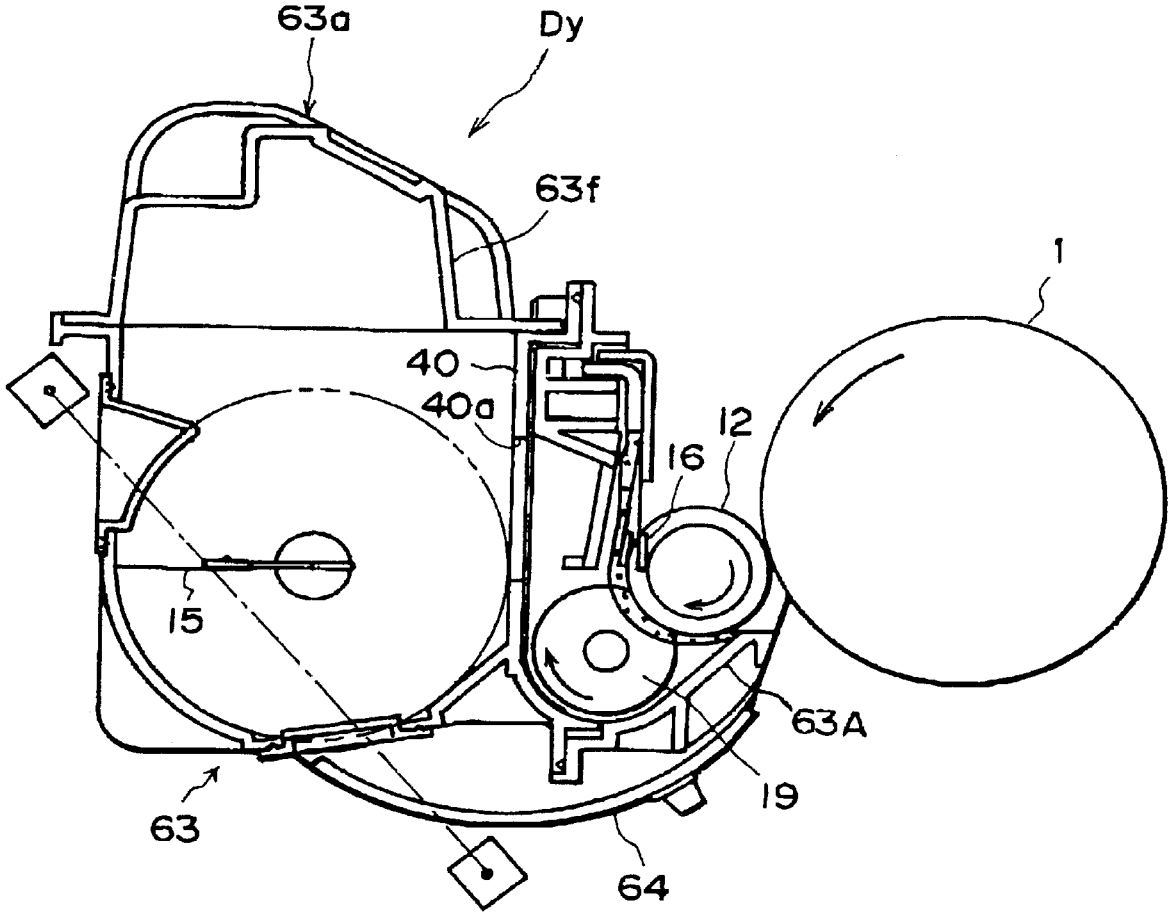
FIG. 4 is a sectional view of the developing cartridge used in an embodiment.

FIG. 4 shows the yellow development cartridge Dy which is standing still, being positioned to oppose the process cartridge U. In the development cartridge Dy, the toner in a toner container 63*a* is sent to a toner supplying roller 19 by a toner sending mechanism 15. Then, the toner is coated in a thin layer on the peripheral surface of the development roller 12, which is rotating in the clockwise direction indicated in the drawing, by the toner supplying roller 19, which is rotating in the clockwise direction indicated also in the drawing, and a development blade 16, which is kept pressed upon the peripheral surface of the development roller 12. While the toner is coated, the toner is given an electrical charge (triboelectrical charge).

Then, a development bias is applied to the development roller 12, which is opposed to the photosensitive drum 1 on which a latent image has been formed, to form a toner image that reflects the latent image on the photosensitive drum 1. The same toner-image-forming process as the one described above with reference to the yellow development cartridge Dy is also carried out in the magenta development cartridge Dm, the cyan development cartridge Dn, and the black development cartridge Db, which are the same in mechanism as the yellow development cartridge Dy described above.

The image forming apparatus main assembly 30 is structured so that, as each development cartridge D is rotated to the development position, its development roller 12 is connected to a high voltage power source and a mechanical driving means (unshown), and development bias is applied to the development roller 12. This process is carried out one after another for all development cartridges in the aforementioned order.

The yellow, magenta, and cyan development cartridges Dy, Dm and Dc, shown in FIG. 4, are the same in structure; they each have the toner supplying roller 19, which is rotationally supported by a developing means holding portion 63A of a cartridge frame 63. The peripheral surface of the toner supplying roller 19 moves in a direction opposite to the direction in which the peripheral surface of the development roller 12 moves.

Figure 5:
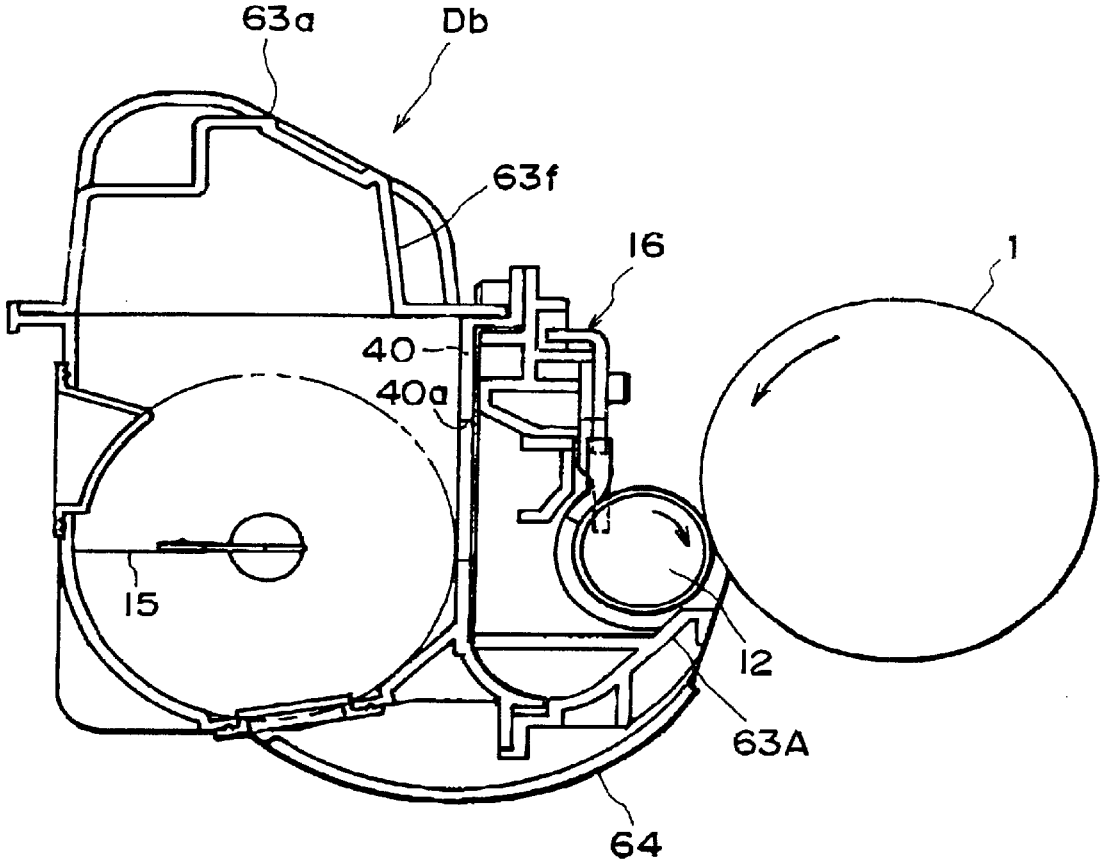
FIG. 5 is a sectional view of a developing cartridge used in an embodiment.

In comparison, the black development cartridge Db shown in FIG. 5 does not have the toner supplying roller 19; toner is adhered to the development roller 12 by a magnetic force, or adheres to the development roller 12 due to its own adhesive force, and the thickness of the toner layer on the development roller 12 is regulated by the development blade 16 placed in contact with the peripheral surface of the development roller 12. As the toner layer on the peripheral surface of the development roller 12 is regulated in thickness, the toner is given a triboelectrical charge.

The intermediary transfer member 4 is a member onto which a toner image is temporarily transferred. More specifically, each time one full-color image is formed, four toner images different in color (Y, M, C and Bk color images), or four visible images different in color, formed on the photosensitive drum 1 by the four developing means, one for one, are transferred in layers onto the intermediary transfer member 4, which is being rotated in the clockwise direction indicated in the drawing, at the same peripheral velocity as that of the photosensitive drum 1. The intermediary transfer member 4 having received a plurality toner images, in layers, transfers, all at once in layers, the color toner images thereon onto the transfer medium P by conveying the transfer medium P by sandwiching the transfer medium P between itself and a transfer roller 6 to which a voltage is being applied. In the intermediary transfer member 4 in this embodiment, an endless transfer belt 4*a* formed of dielectric material is stretched around a drive roller 4*b*, a follower roller 4*c*, a secondary transfer counter roller 4*d*, and a primary transfer roller 4*e*. The primary transfer roller 4*e* is positioned in a manner to sandwich the transfer belt 4*a* between itself and the photosensitive drum 1.

The cleaning means 9 is a means for removing, from the photosensitive drum 1, the toner remaining on the photosensitive drum 1 after the toner image, or a visual image, formed on the photosensitive drum 1 by the developing means is transferred by the intermediary transfer member 4. The toner removed from the photosensitive drum 1, or residual toner T is collected in a residual toner container 9*a*. The amount of the residual toner is not large enough to fill up the residual toner container 9*a* before the service life of the photosensitive drum 1 expires. Thus, the residual toner container 9*a*, which is a part of the process cartridge U, is replaced with a new one, at the same time as the process cartridge U is replaced with a new one due to the expiration of the service life of the photosensitive drum 1.

The conveying means 5, the most upstream portion of which in terms of the recording-medium-conveyance direction is a sheet feeder portion, is a means for conveying the transfer medium P to the image forming portion. It essentially comprises: a cassette 5*a* in which a plurality of transfer media P are stored; a sheet feeder roller 5*b*, a combination of a sheet feeder roller 5*c*1 and a retarder roller 5*c*2 for preventing the recording medium P from being fed by two or more guides 5*g*, and a registration roller 5*e*.

In an image forming operation, the sheet feeder roller 5*b* is rotationally driven in synchronism with the image forming operation to feed the recording media P within the cassette 5*a* into the apparatus main assembly, one by one. Then, each recording medium P is conveyed, while being guided by sheet guides 4*g*, to the registration roller 5*e* past the sheet feeder roller 5*e*1.

During the image forming operation, the registration roller 5*e* carries out, in a predetermined sequence, a process in which it remains still to keep the recording medium P on standby, and a process in which it rotates to release and convey the recording medium P toward the intermediary transfer member 4, so that the released transfer medium P aligns with an image during the following process, that is, the transfer process.

The transferring portion comprises the transfer roller 6, which can be moved in the direction to be pressed upon the transfer belt 4*a*, or in the direction to be separated therefrom. The transfer roller 6 comprises a metallic shaft, and a layer of foamed elastic material wrapped around the peripheral surface of the metallic shaft. The electrical resistance of the foamed elastic material layer is in the medium range. It is movable in the vertical direction of the drawing, and is connected to a mechanical driving means.

While the above mentioned four toner images are formed on the intermediary transfer member 4, that is, while the intermediary transfer member 4 rotates a plural number of times, the transfer roller 6 is kept at the bottom position outlined by a bold line in the drawing, being kept away from the intermediary transfer member 4, to prevent the transfer roller 6 from disturbing the images while they are being formed.

Then, as the formation of the four toner images different in color on the intermediary transfer member 4 ends, the transfer roller 6 is moved to the top position outlined by a fine line in the drawing, by an unshown cam, in synchronism with the timing with which the multi-color image, or the combination of the four color toner images, is to be transferred onto the recording medium P. In other words, the transfer roller 6 is pressed upon the intermediary recording member 4, with the interposition of the recording medium P between the intermediary transfer member 4 and transfer roller 6. At the same time as the transfer roller 6 is pressed upon the intermediary transfer member 4, a bias begins to be applied to the transfer roller 6. As a result, the toner images on the intermediary transfer member 4 are transferred onto the recording medium P.

The intermediary transfer member 4 and transfer roller 6 are driven independently from each other. Therefore, as the transfer process progresses, the recording medium P being sandwiched between two rollers is conveyed leftward of the drawing at a predetermined velocity to a fixing portion 7, in which the following process is carried out.

The fixing portion 7 is a portion for fixing the toner images, which have been formed on the photosensitive drum 1 by developing means and have been transferred onto the recording medium P. It includes: a fixing roller 7*a* for applying heat to the recording medium P, and a pressure roller 7*b* for pressing the recording medium P upon the fixing roller 7*a*. Both rollers 7*a*and 7*b* are hollow and contain a heater. They are rotationally driven and convey together the recording medium P.

More specifically, as the recording medium P, which is holding the toner images, is conveyed by the fixing roller 7*a* and pressure roller 7*b*, heat and pressure are applied to the recording medium P and toner images thereon. As a result, the toner images are fixed to the recording medium P.

Next, how the development cartridge is mounted will be described.

First, an unshown button of the main assembly 30 is pressed. As the button is pressed, the rotary unit 11 rotates until a specific development-cartridge mounting slot of the rotary unit 11, the color designation of which matches the color of the development cartridge D the user wished to mount, comes to a predetermined position at which the development cartridge D can be mounted. In other words, the rotary unit 11 stops there, when one of development cartridge mounting slots 14*y*, 14*m*, 14*c* and 14*b*, which each occupy one quarter of the rotary unit 11, aligns with a development-cartridge mounting opening 17.

Next, the user opens a cover 18 of the development-cartridge mounting opening 17 located at a predetermined portion of the main assembly 30. Normally, the opening 17 is kept covered with the cover 18.

Then, guide ribs 70 (FIG. 6) on the side walls of a shutter 64 (which will be described later in detail) of the development cartridge D identical in color to the color designation of the development cartridge mounting slot, which is at the point aligning with the opening 17, is rested on cartridge guides 59*f* on the internal walls of the rotary unit 11 of the apparatus main assembly 30, and the development cartridge D is pushed inward (FIG. 2). At this point, the operator grasps by hand a handhold recess 63*f* (FIG. 7) integral with the toner container 63*a* of the development cartridge D, and turns the development cartridge D in the direction indicated by an arrow mark a in FIG. 1. As the development cartridge D is turned, only the actual development unit D rotates, with the shutter 64 remaining held to the rotary unit 11. As a result, the development roller 12 is exposed, to be ready for development (FIG. 5).

Figure 6:
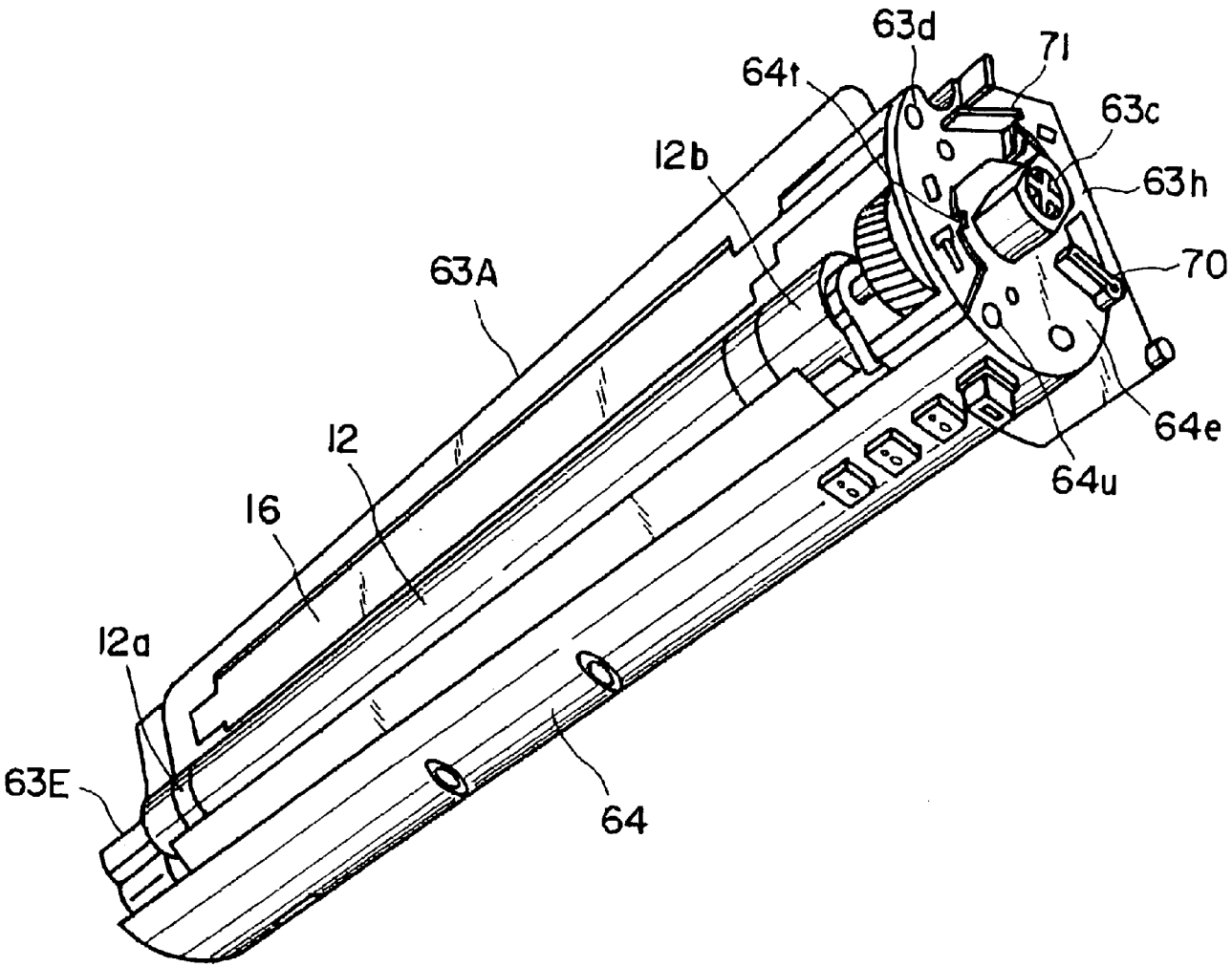
FIG. 6 is a perspective view of a developing cartridge according to an embodiment of the present invention.
Figure 7:
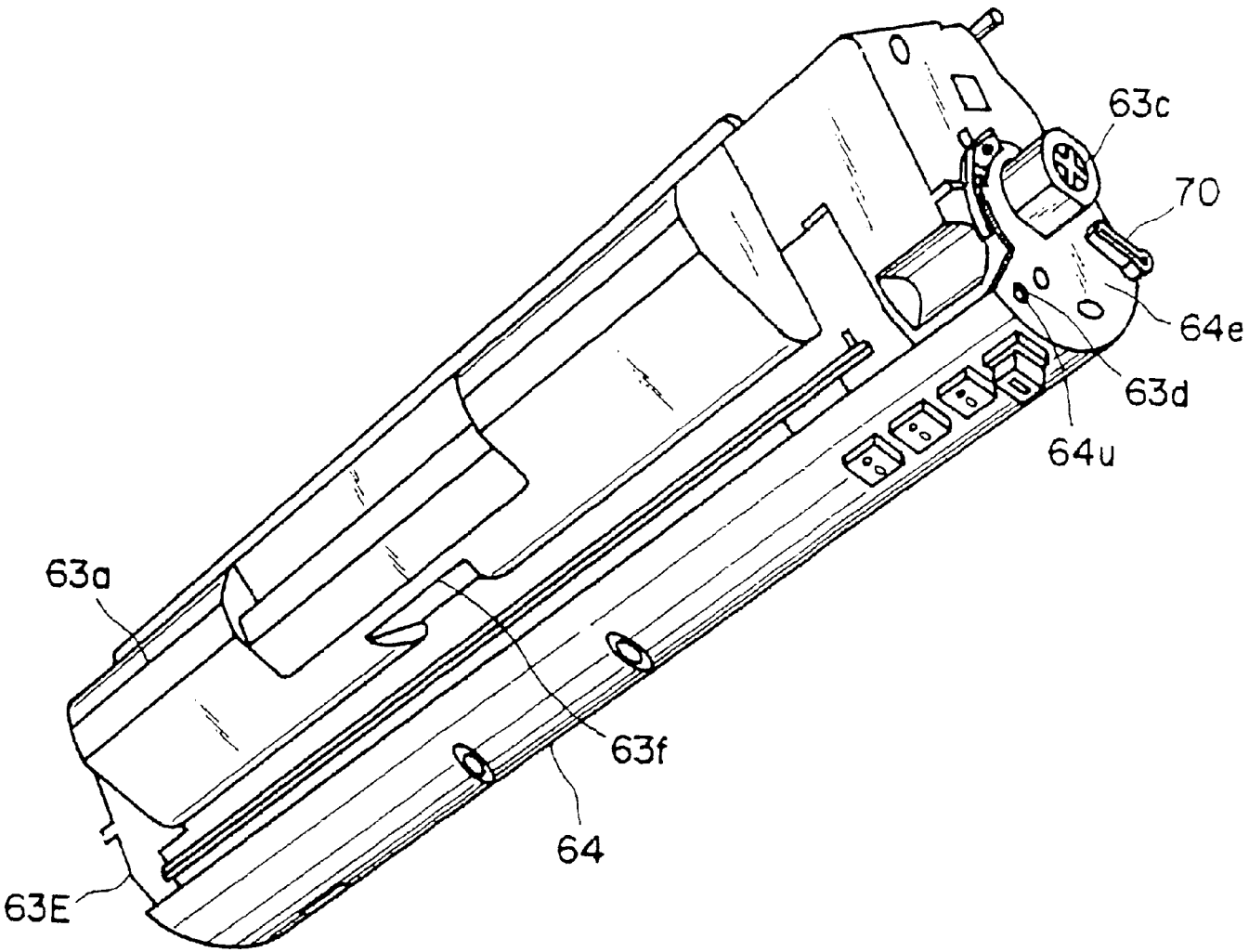
FIG. 7 a perspective view of a developing cartridge according to an embodiment of the present invention.

Next, referring to FIGS. 6–8, the shutter 64 of the development cartridge D will be described.

Figure 8:
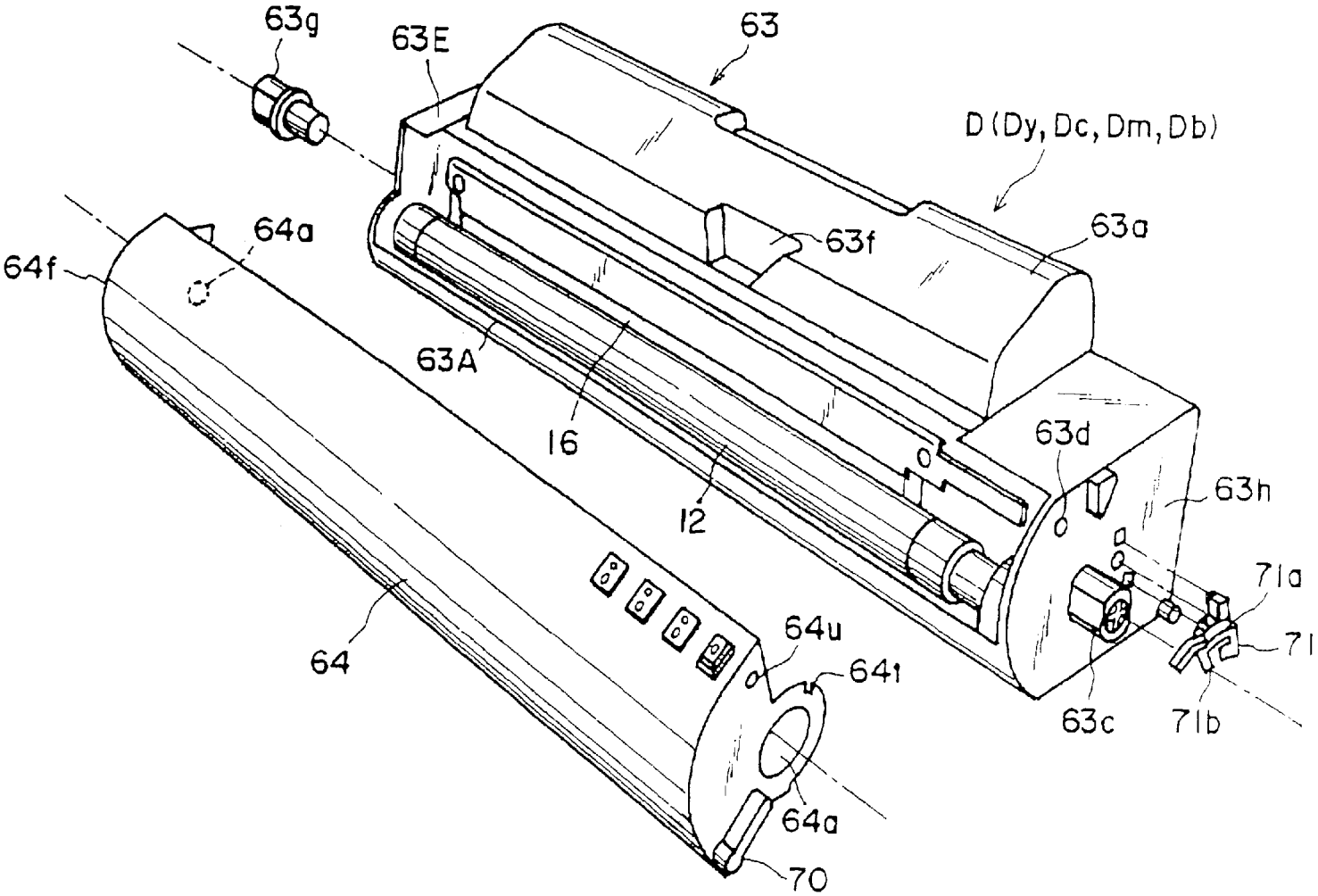
FIG. 8 is an exploded perspective view of a developing cartridge according to an embodiment of the present invention.

Referring to FIG. 8, both side walls 64*e* and 64*f* of the shutter 64 in terms of the lengthwise direction of the shutter 64 are provided with a round hole 64*a*, into which the projections 63*c* and 63*g* projecting, one for one, from the side walls of the hand hold recess 63*f* in terms of its lengthwise direction, are fitted to rotationally support the shutter 64 by the cartridge frame 63. Next, referring to FIGS. 6 and 7, the shutter 64 is enabled to take the covering position at which it covers the development roller 12, or the retracted position at which it exposes the development roller 12. When the development cartridge D is out of the main assembly 30, the shutter 64 remains closed. Therefore, when the development cartridge D has never been used, it does not occur that dust and the like adheres to the development roller 12, or that the development roller 12 is damaged.

The cartridge frame 63 is provided with a locking member 71 for keeping the shutter 64 locked in the closed state, which is on one of the side walls 63*e*, in the areas adjacent a projection 63*c*. The locking member 71 comprises an elastic arm portion 71*a* and an engaging portion 71*b*. On the other hand, one of the side walls 64*e* of the shutter 64, on the same side as the locking member 71, is provided with a recess 64*t*, which is located at a predetermined position, and with which the engaging portion 71*b* engages. Thus, when the shutter 64 is in the closed state, the engaging portion 71*b* remains engaged in the recess 64*t*, keeping the shutter 64 locked in the closed state to prevent the shutter 64 from accidentally opening.

As the development cartridge D is inserted into the main assembly 30, the locking member is automatically released to allow the shutter 64 to be opened.

Further, the side walls 64*e* and 64*f* of the shutter 64 are provided with a round hole 64*u*, and side walls 63*h* of the development cartridge are provided with a semispherical projection 63*d*, the position of which corresponds to that of the round hole 64*u*. Thus, when the shutter 64 is in the closed state, the semispherical projections 63*d* remain engaged in the corresponding round holes 64*u*, and therefore, even after the shutter 64 is unlocked as described above, the positional relationship between the shutter 64 and development cartridge D in terms of the rotational direction of the shutter 64 does not become unstable.

Next, referring to FIGS. 9–19, the structure of an embodiment of an automatic mechanism for opening a toner seal member, in accordance with the present invention, will be described in detail.

In the automatic toner seal member opening mechanism, which will be described below, a toner seal member 41 is provided with a regulating portion 41*e* for regulating a detection lever for detecting the winding of the toner seal member 41, and the toner seal member 41 is kept pressed upon the regulating portion 41*e*. The completion of the winding of the toner seal member 41 is detected as the detection lever 82*b* is automatically moved as the winding of the toner seal member 41 is completed.

The transmission of the driving force to a winding shaft 42 is automatically stopped by a stopping member as the detection lever 82*b* is allowed to move, by the completion of the winding of the toner seal member 41.

The provision of the above described mechanism, in which the toner seal member is given the function of regulating the detecting means for detecting the completion of the winding of the toner sealing member, and the transmission of a driving force to the winding shaft is automatically stopped as the completion of the winding of the toner seal member is detected, assures that the completion of the winding of the toner seal member is accurately detected. As a result, the scattering of toner and/or the generation of strange noises, which is caused by the flapping of the toner seal member, does not occur. Further, the load exerted upon the motor is reduced.

Figure 9:
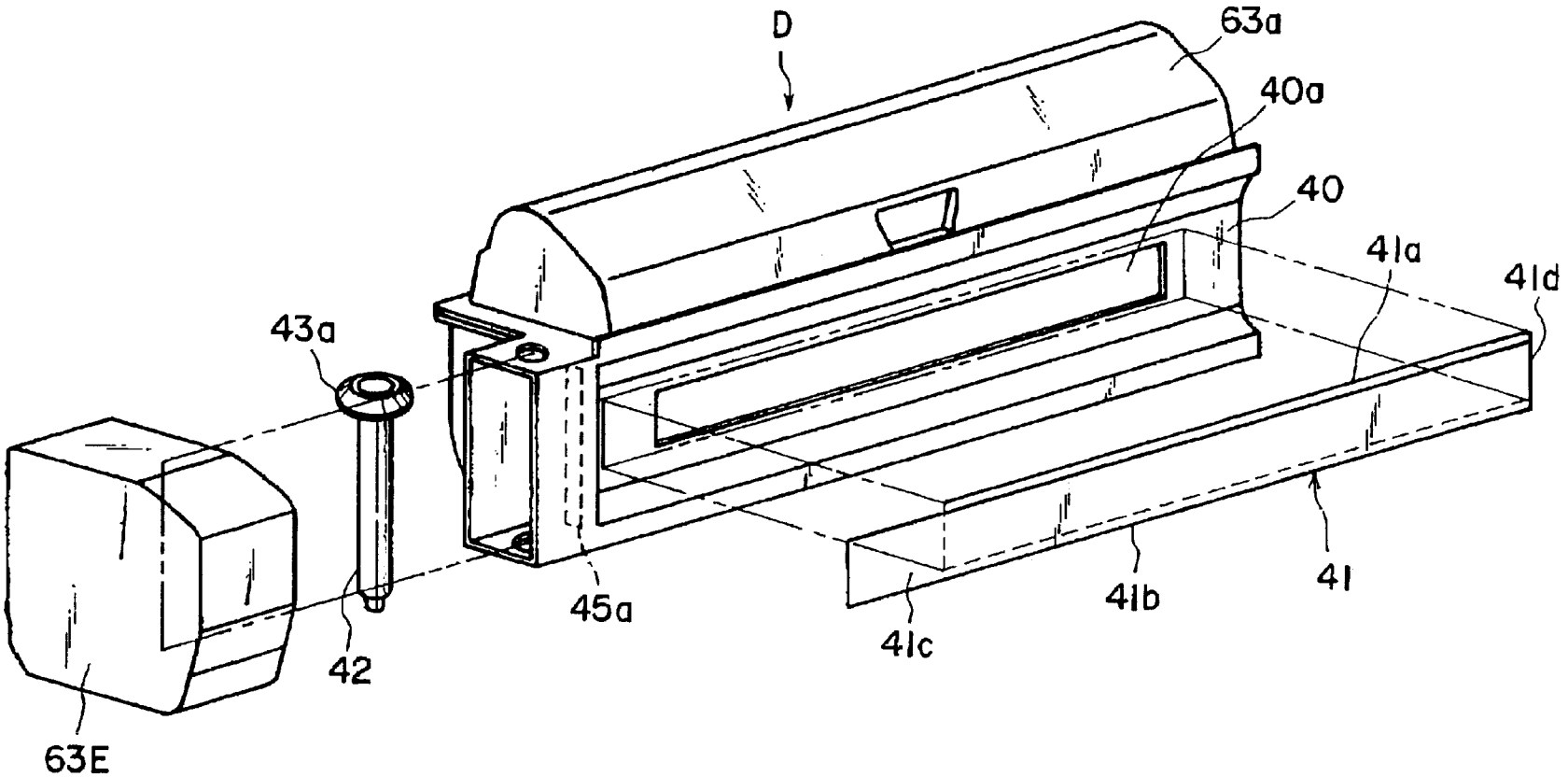
FIG. 9 is an exploded perspective view illustrating a toner seal structure according to an embodiment of the present invention.
Figure 10:
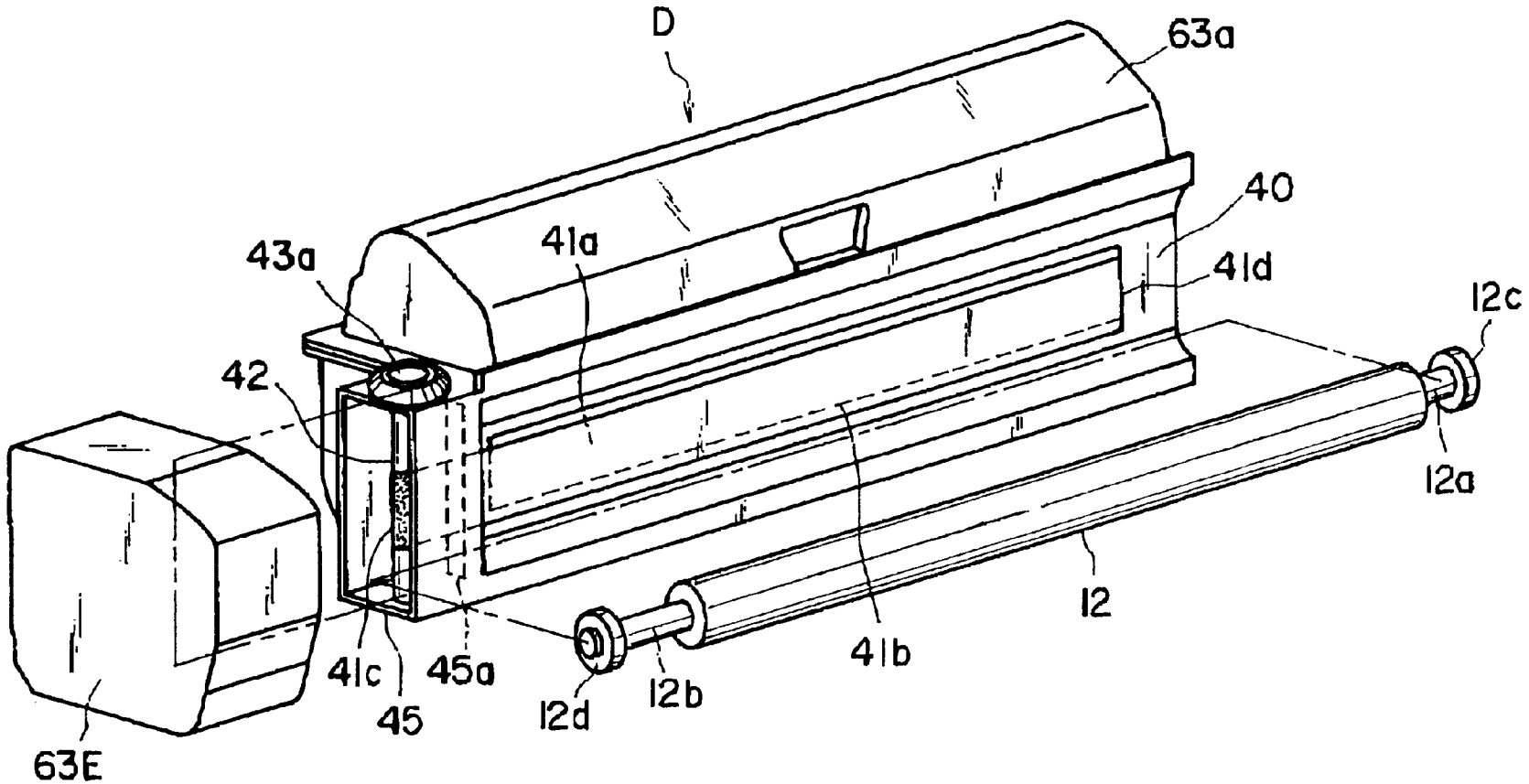
FIG. 10 is an exploded perspective view illustrating a toner seal structure according to an embodiment of the present invention.

The frame of the development cartridge D includes a toner container portion 63*a* in which toner is stored, and a developing means holding portion 63A. Referring to FIG. 9, a wall 40 of the toner container portion 63*a*, on the developing means holding portion 63A side, is provided with a toner supplying opening 40*a*, along the fringe of which the toner sealing member 41 is peelably pasted with the use of thermal welding or the like, to keep the toner sealed within the toner container portion 63*a* to prevent the toner from scattering while the development cartridge D is delivered to a user, that is, during the transportation of the development cartridge D. In this embodiment the toner seal member 41 is formed of a flexible sheet. FIGS. 9 and 10 show the structure of a toner sealing means in accordance with the present invention. The length of the toner seal member 41 is more than twice the measurement of the aforementioned opening 40*a* in terms of the lengthwise direction of the opening 40*a*. The toner seal member 41 comprises: a sealing portion 41*a* peelably attached to the fringe of the opening 40*a* in a manner to seal the opening 40*a* by such a means as thermal welding, and a doubling portion 41*b*, which is continuous with one end of the sealing portion 41*a*. The doubling portion 41*d* is folded back at a double back point 41*d* in the adjacencies of the end of the opening 40*a*, in terms of its length direction, at which the two portions are continuous. It is doubled back on the sealing portion 41*a*, to the other end of the opening 40*a*. An end portion 41*c* of the doubling portion 41*b*, which is not continuous with the sealing portion 41*a*, is fixed to a winding shaft 42 with the use of adhesive or the like. The winding shaft 42 is enabled to be rotated about a rotational axis perpendicular to the axial line of the development roller 12, being rotationally supported by the toner container portion 63*a*. One end of the winding shaft 42 is provided with a first bevel gear 43*a* for rotating the winding shaft 42, which is an integral part of the winding shaft 42.

Referring to FIG. 10, a flange 12*b* of the development roller 12, on the winding shaft 42 side, is provided with the development roller gear, which is firmly fixed thereto, and is used for transmitting the driving force inputted from the main assembly (image forming apparatus main assembly), which will be described later, to the winding shaft 42. The development roller gear B12*d* and winding shaft 42 are connected to each other through a gear train provided on a side holder 63E, which will be described later. The side holder 63E is attached to one end of the toner container portion 63*a* in terms of the lengthwise direction.

Figure 11:
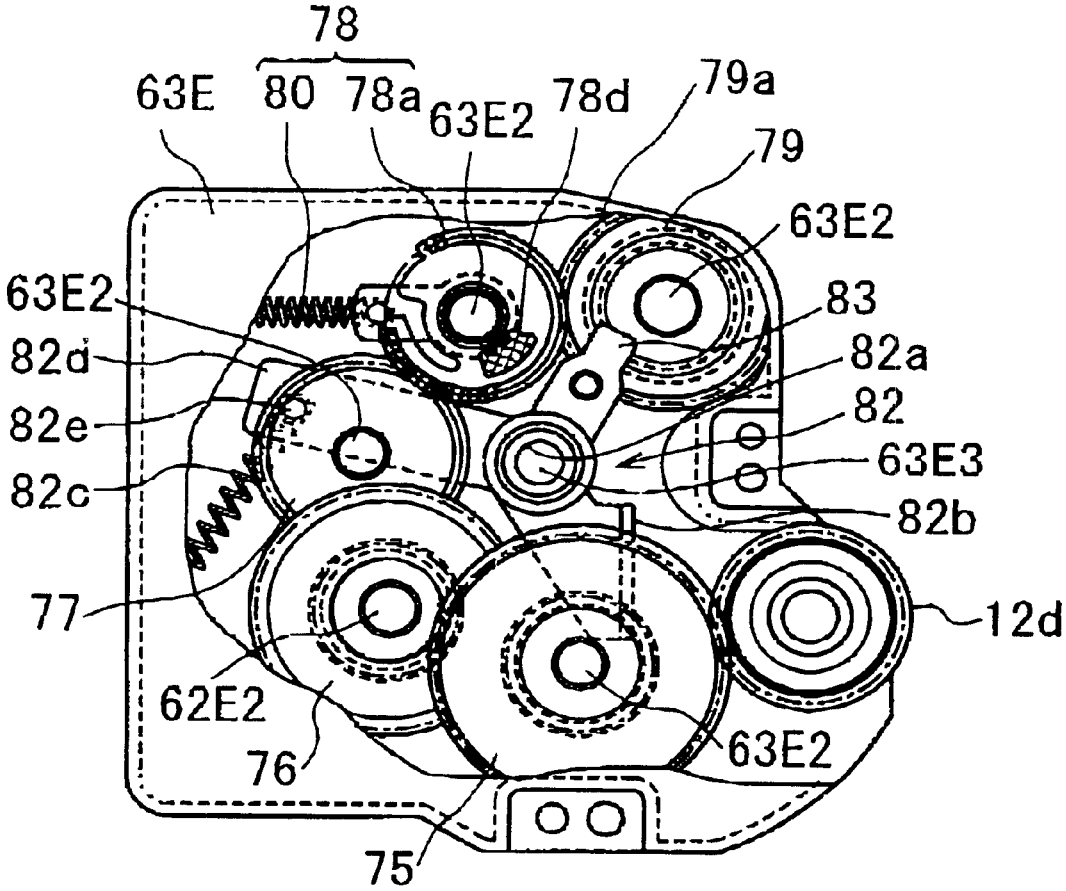
FIG. 11 is a front view of an automatic unsealing mechanism of a toner seal member according to an embodiment of the present invention.
Figure 12:
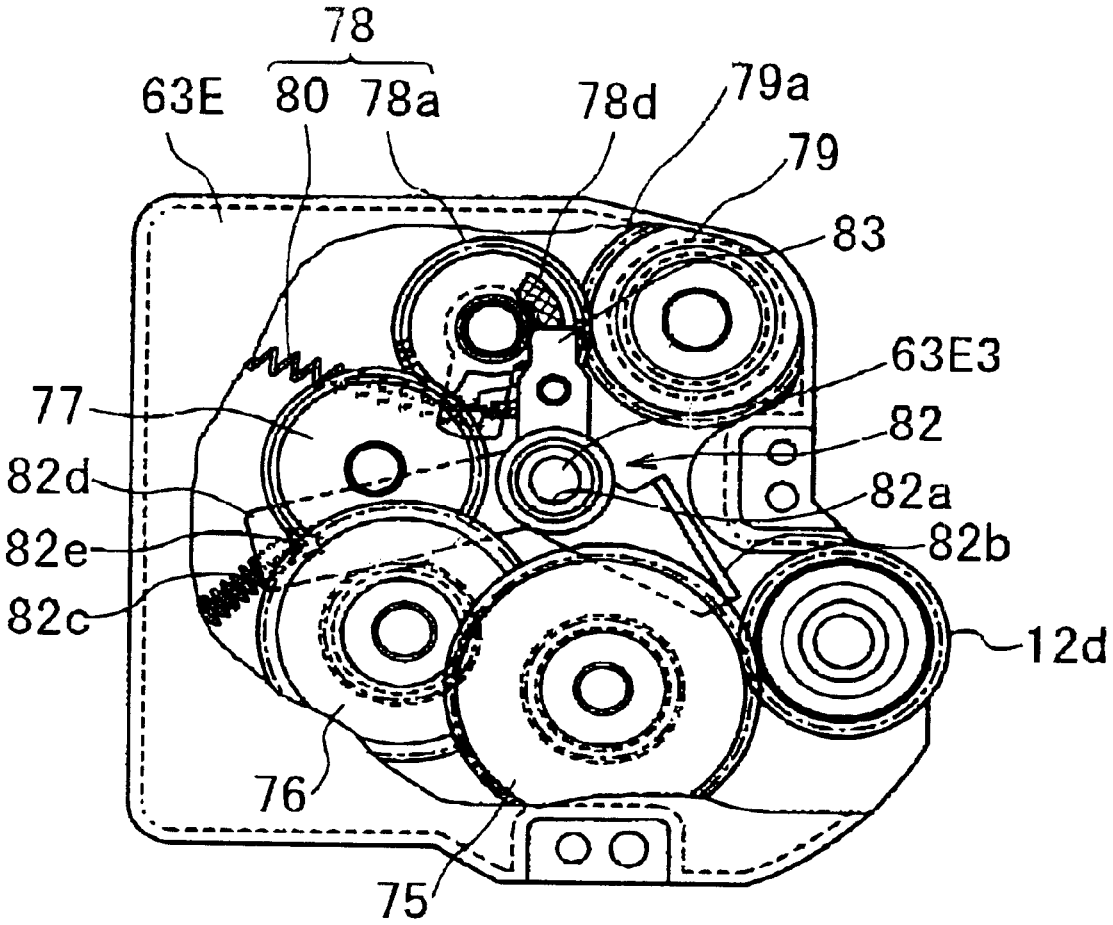
FIG. 12 is a front view of an automatic unsealing mechanism of a toner seal member according to am embodiment of the present invention.

Next, referring to FIGS. 11 and 12, the positions of the gears of the gear train mounted on the side holder 63E for transmitting the driving force from the image forming apparatus main assembly 30 will be described. FIGS. 11 and 12 show the state of the gear train before and after the toner sealing member 41 is wound, respectively. On the plurality of shafts 63E2 with which the side holder 63E is provided, idler gears, a partially teeth missing gear, and a second bevel gear 79, are rotationally supported, one for one. More specifically, to list the gears rotationally supported by the side holder 63E from the upstream side in terms of the direction in which the driving force inputted from the image forming apparatus main assembly 30 is transmitted to the winding shaft, the first one is the idler gear meshed with the development roller gear, and the second gear is the idler gear for reducing the revolution of the development roller gear, at which the development roller 12 is driven, to a predetermined revolution. The next gear is the idler gear. The idler gears and are step gears, and in order to transmit the driving force, the smaller diameter portion of the idler gear is meshed with the large diameter portion of the idler gear, whereas the smaller diameter portion of the idler gear is meshed with the idler gear. The idler gear is meshed with the partially teeth missing gear 78*a*, which is meshed with the second bevel gear 79, which is meshed with the first bevel gear 43*a* integral with the winding shaft 42. The driving force inputted from the image forming apparatus main assembly 30 is transmitted to the winding shaft 42 through the above described gear train. The second bevel gear 79 has a gear 79*a* integral with the second bevel gear 79. The gear 79*a* is a spur gear and is meshed with the partially teeth missing gear 78*a*.

Figure 13:
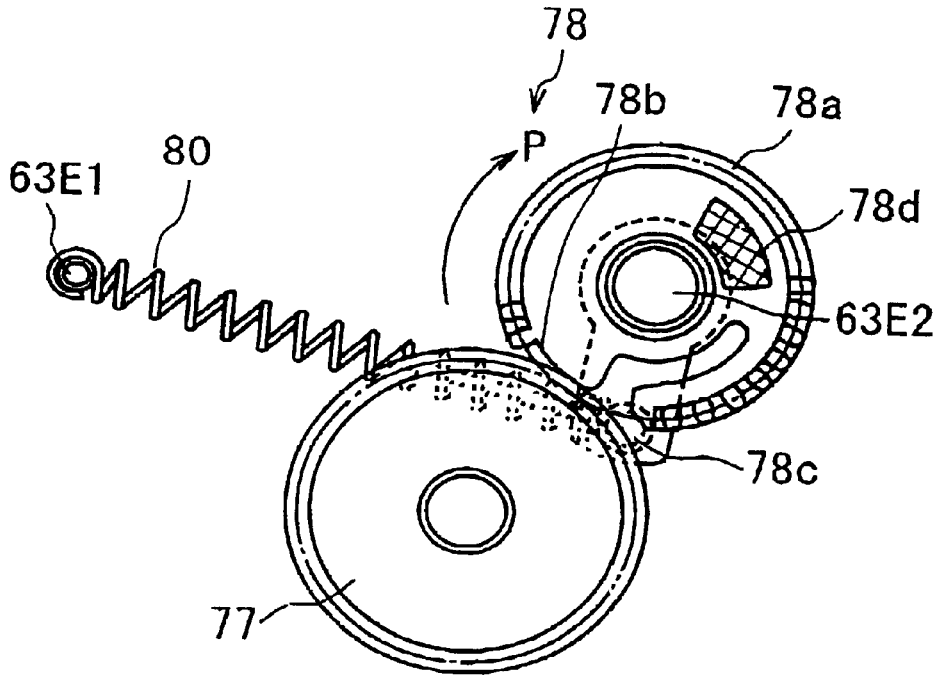
FIG. 13 is a front view of a teeth-missing-type clutch mechanism according to an embodiment of the present invention.
Figure 14:
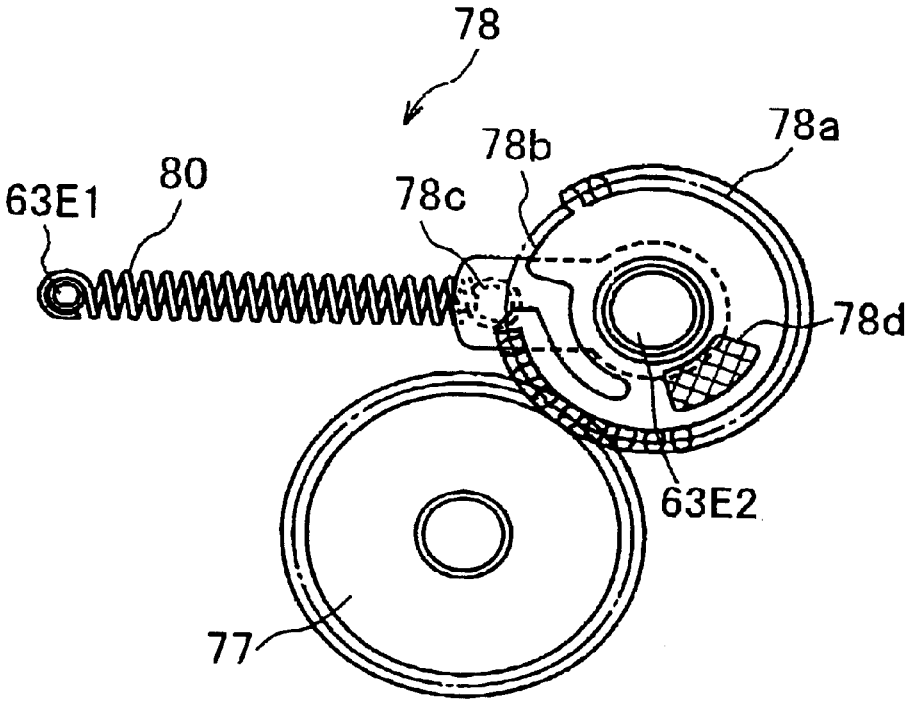
FIG. 14 is a front view of a teeth-missing-type clutch mechanism according to an embodiment of the present invention.

Referring to FIG. 13, a clutch 78 comprises the partially teeth missing gear 78*a* (1/10–1/5 of the entire teeth are missing), which has a portion 78*b* across which the teeth are missing, and a spring 80. One end of the spring 80 is hung on a shaft 78*c* located at the end of an arm portion on the inwardly facing surface of the partially teeth missing gear 78*a* in terms of the lengthwise direction of the development cartridge D, keeping the partially teeth missing gear 78*a* under a rotational force. The other end of the spring 80 is hung on a spring hanger 63E1 of the side holder 63E. The spring 80 is a tension coil spring. Referring to FIG. 13, as the driving force is inputted, the meshing between the idler gear and partially teeth missing gear 78*a* is temporarily nullified while the teeth missing portion 78*b* of the partially teeth missing gear 78*a* is opposing the idler gear. As the meshing is nullified, that is, the two gears become disengaged, the partially teeth missing gear 78*a*, which is under the rotational force (directed as indicated by arrow mark P in FIG. 13) from the spring 80, rotates until it meshes again with the idler gear as shown in FIG. 14. This sequence of disengaging and engaging occurs once for each full turning of the partially teeth missing gear 78*a*. More specifically, before the toner sealing member 41 is wound, the clutch 78 and idler gear remain engaged as shown in FIG. 11. The outwardly facing surface of the partially teeth missing gear 78*a* in terms of the lengthwise direction is provided with a projection 78*d*. The projection 78*d* is an integral part of the partially teeth missing gear 78*a*.

Further, the side holder 63E is provided with a detecting means for detecting the completion of the winding of the toner seal member 41, and a stopper 83 which is for stopping the transmission of the driving force to the winding shaft 42, and moves in coordination with a detecting means 82. The detecting means 82 is rotationally supported by a shaft 63E3 with which the side holder 63E is provided; the shaft 63E3 is put through a hole 82*a* of the detecting means 82. The detecting means 82 comprises the detection lever 82*b* as a detecting member, which is extended in the radial direction of the shaft 63E3 and is kept pressed upon the regulating portion 41*e* (FIG. 15) of the doubling portion 41*b* of the toner seal member 41, by the pressure generated by a spring 82*c*2. Further, the aforementioned stopper 83, which is an integral part of the detecting means 82, is moved to be placed in contact with the projection 78*d* of the clutch 78, by the detection lever 82*b* of the detecting means 82 in response to the detection of the completion of the winding of the toner seal member 41. One end of the aforementioned spring 82*c* is hung on a spring hanger 82*e*, an integral part of the arm 82*d*, located at the end of an arm 82*d*, and the other end is anchored to the side holder 63E. The spring 82*c* is a tension spring.

Referring to FIG. 10, in this embodiment, the winding shaft 42 is covered with a winding shaft cover 45, which is an integral part of the toner container portion 63*a*, or is formed independently from the toner container portion 63*a* and is fixed to the toner container portion 63*a* by welding or the like. The winding shaft cover 45 is provided with a slit 45*a* through which the toner sealing member 41 is put; the end of the doubled portion 41*c* is put through the slit 45*a* and is fixed to the winding shaft 42.

Next, the movement of the automatic toner seal member opening mechanism structured as described above will be concretely described.

Figure 15:
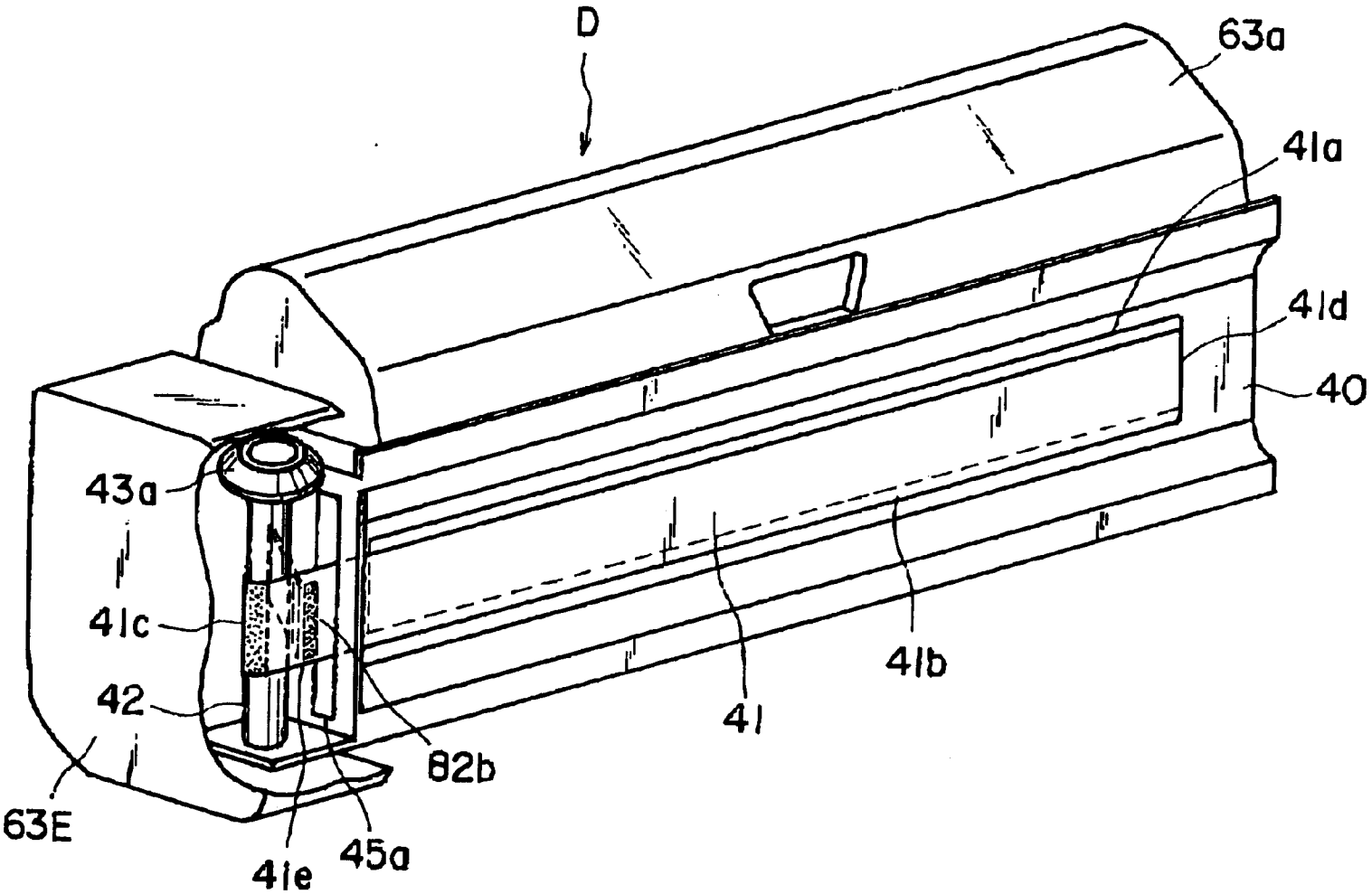
FIG. 15 is a perspective view of a toner seal member winding-up detection structure according to an embodiment of the present invention.

Referring to FIG. 15, before the toner seal member 41 is wound, the detection lever 82*b* of the detecting means 82 is in contact with the regulating portion of the doubling portion 41*b* of the toner seal member 41, being prevented from moving. In this state, the stopper 83 is away from the position at which it contacts the projection 78*d* of the clutch 78 (see FIG. 17). As the development cartridge D in this state is mounted in the image forming apparatus main assembly 30, the driving force is inputted to a driving force input gear (unshown) located at the opposite end of the development cartridge, with respect to the winding shaft 42. Referring to FIG. 10, the driving force input gear is meshed with a development roller gear attached to a flange 12*a* of the development roller 12, and rotationally drives the development roller 12; the flange 12*a* is located on the opposite side of the development roller 12 with respect to the winding shaft 42 in terms of the lengthwise direction. Thus, the driving force is transmitted to the winding gear 42 through the aforementioned gear trains comprising the development roller gear, idler gears and, partially teeth missing gear 78*a*, gear 79*a*, second bevel gear 79, and first bevel gear 43*a*, to rotate the winding shaft 42.

As is evident from the above description, the toner seal member 41, which has been airtightly sealing the opening 40*a* as shown in FIG. 10, is wound around the winding shaft 42. As the toner seal member 41 is completely wound up by the winding shaft 42, the opening 40*a* becomes fully open, allowing toner to be supplied to the development roller 12.

Figure 16:
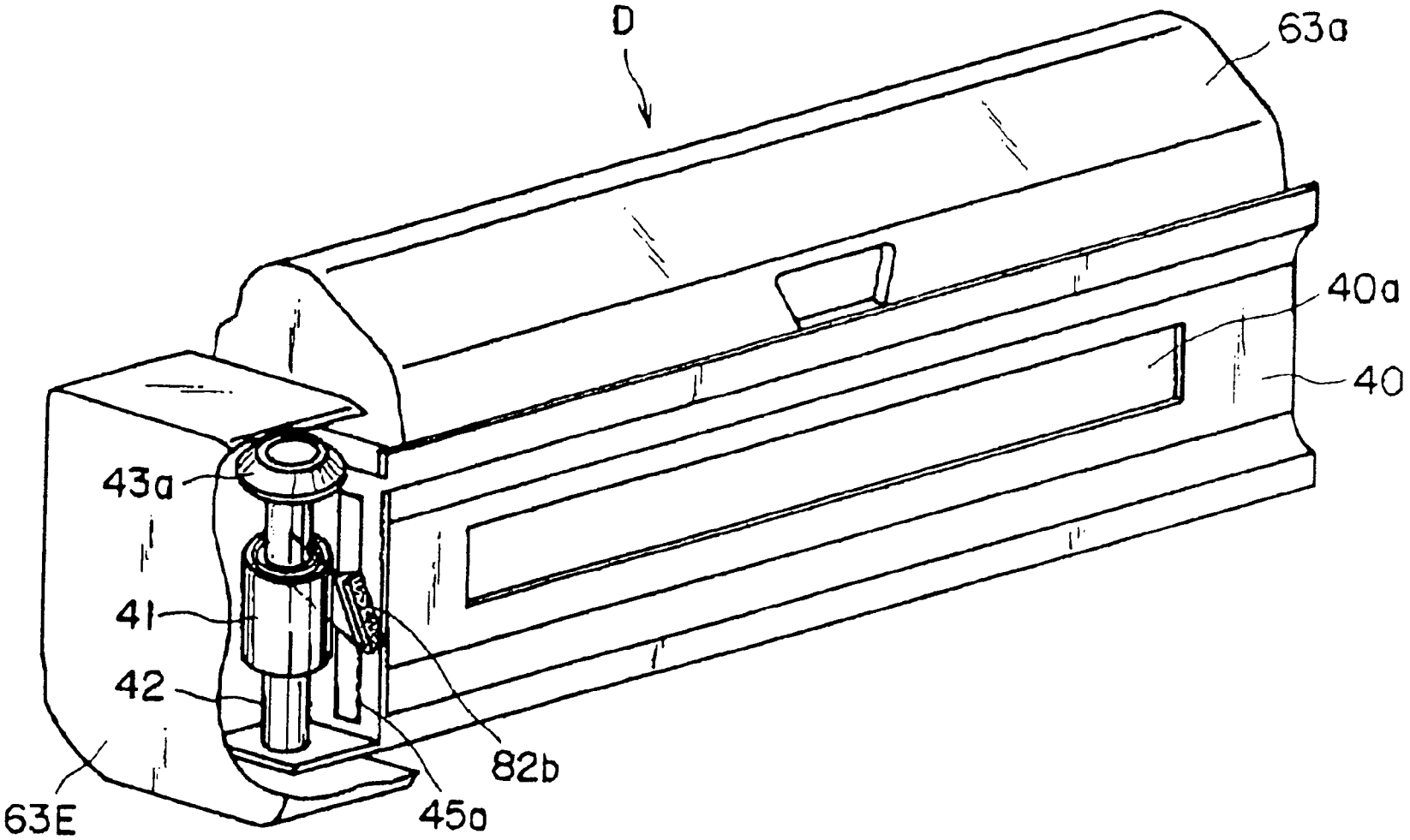
FIG. 16 is a perspective view of a toner seal member winding-up detection structure according to an embodiment of the present invention.
Figure 17:
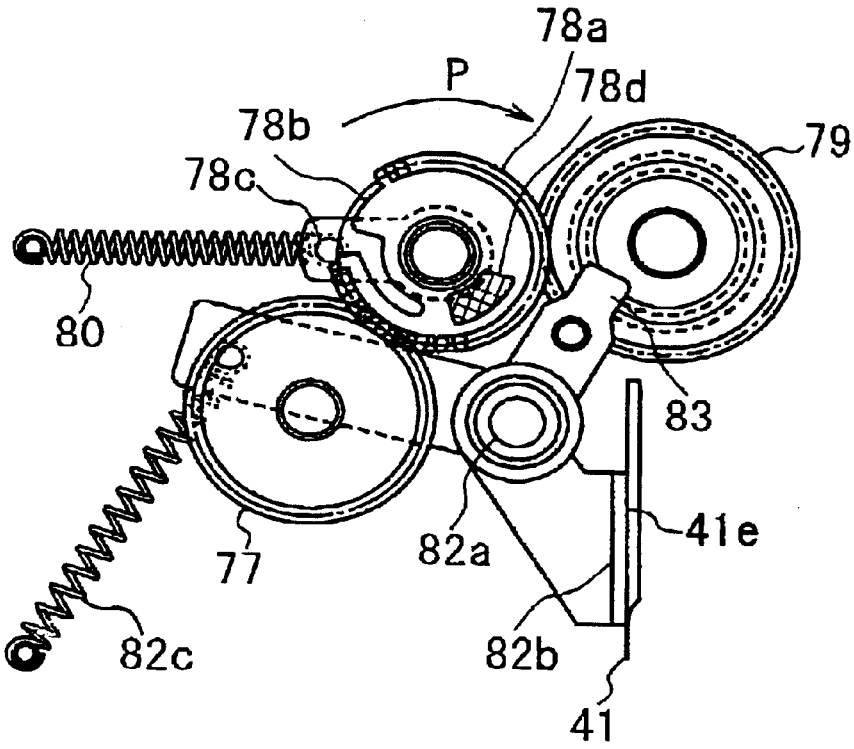
FIG. 17 is a front view of a driving blocking mechanism according to an embodiment of the present invention.

Next, referring to FIG. 16, as the toner seal member 41 is completely wound up by the winding shaft 42, the regulating portion 41*e* of the toner sealing seal 41 is also wound away. In other words, the regulating portion 41*e*, which has been preventing the detection lever 82*b* of the detecting means 82 from moving, is removed. As a result, the detection lever 82*b* is allowed to rotate about the axial line of the hole 82*a*, in the direction in which it is pressured by the spring 82*c*; in other words, the completion of the winding of the toner seal member 41 is detected. Also as the completion of the winding of the toner seal member 41 is detected, the stopper 83 comes into contact with the projection 78*d* of the clutch 78, preventing the driving force from being transmitted to the winding shaft 42.

Figure 18:
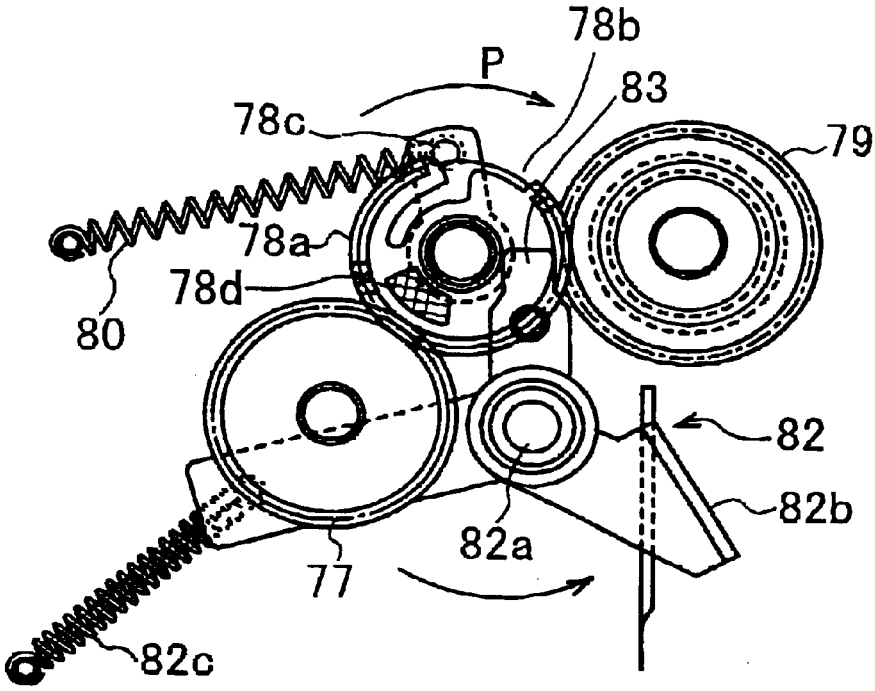
FIG. 18 is a front view of a driving blocking mechanism according to an embodiment of the present invention.
Figure 19:
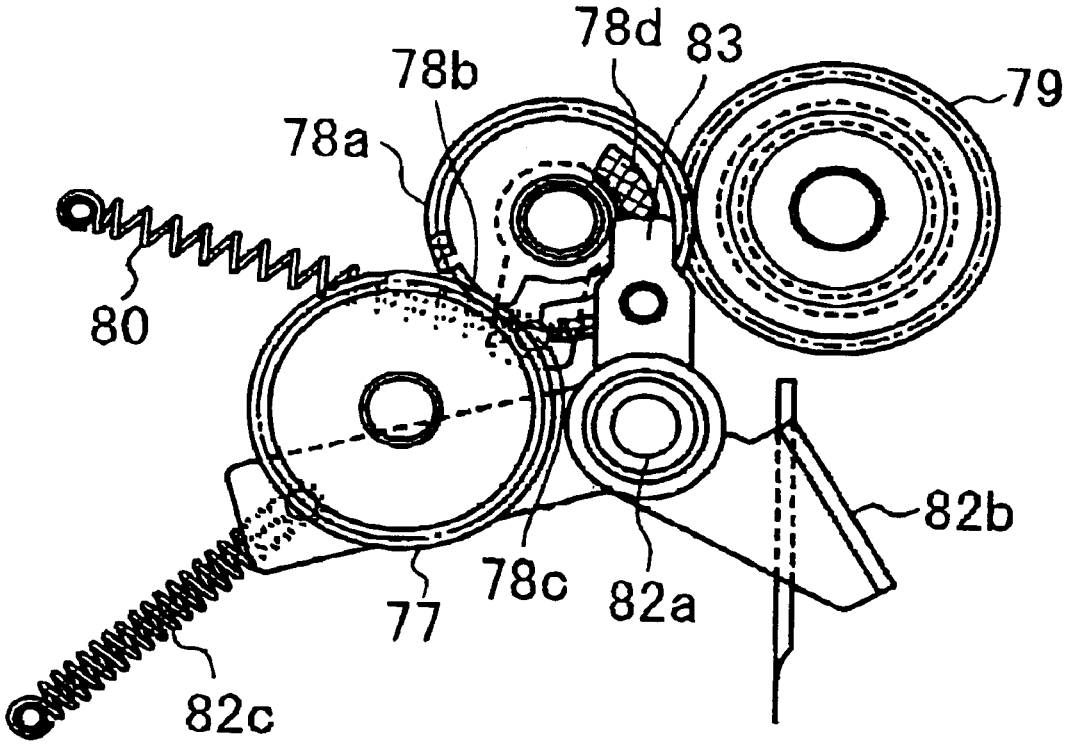
FIG. 19 is a front view of a driving blocking mechanism according to an embodiment of the present invention.

At this time, the driving force transmission stopping mechanism of the clutch 78 will be described in detail. FIG. 18 shows the state in which the detecting means 82 has detected the completion of the winding of the toner seal member 41, and the stopper 83 has moved to the point at which it can come into contact with the projection 78*d* of the clutch 78. In this state, the idler gear and partially teeth missing gear 78*a* are still meshed with each other, and the projection 78*d* has not reached the point at which it comes into contact with the stopper 83; in other words, the transmission of the driving force to the winding shaft 42 has not been stopped. Then, as the clutch 78 is rotated further by receiving the driving force from the idler gear, the teeth missing portion 78*b* of the partially teeth missing gear 78*a* comes into the range in which it opposes the idler gear, causing the two gears to disengage from each other, as shown in FIG. 19. As the two gears disengage, the rotational force from the spring 80, under which the partially teeth missing gear 78*a* is kept, works on the partially teeth missing gear 78*a* in the direction to rotate the gear 78*a* in reverse to make the gear 78*a* reengage with the idler gear. However, the projection 78*d* comes into contact with the stopper 83 before the reengagement occurs, and therefore, the partially teeth missing gear 78*a* is not allowed to reengage with the idler gear. Therefore, the transmission of the driving force does not occur any more. As the transmission of the driving force to the partially teeth missing gear 78*a* stops, the transmission of the driving force to the second bevel gear 79 and first bevel gear 43*a* also stops. Therefore, it does not occur that the driving force is transmitted to the winding shaft 42 for the second time. Thus, it does not occur that the driving force is transmitted to the winding shaft 42 after the completion of the winding of the toner seal member 41. In other words, it does not occur that the driving force is unnecessarily transmitted to the winding shaft 42. Therefore, the flapping of the end portion of the toner seal member 41 and/or touching of the end portion of the toner seal member 41 on the adjacencies, which causes the scattering of toner, the generation of strange noises, and the like problems, do not occur. Further, the load exerted upon the motor of the image forming apparatus main assembly 30 after the completion of the winding of the toner sealing member 41 is smaller.

In this embodiment, the transmission of the driving force to the winding shaft 42, the axial direction of which is different from that of the gear from which it receives the driving force, is accomplished with the use of a bevel gear. However, the application of the present invention is not limited to this structural arrangement. For example, the transmission of the driving force to the winding shaft 42 different in the axial direction from the gear from which it receives the driving force may be accomplished with the use of a worm gear or the like. Further, the detection lever, as a detecting member, of the detecting means, which elastically contacts the regulating portion 41*e* of the toner seal member, may be replaced with a rod that makes direct movement. In such a case, the rod is provided with a stopper which can be engaged with or disengaged from the projection 78*d* of the partially teeth missing gear 78*a*.

Also in this embodiment, the structure of the image forming apparatus is such that the process cartridge and development cartridge are independent from each other, and can be separately mounted into or dismounted from the apparatus main assembly. However, the application of the present invention is not limited to such a structural arrangement. For example, the structure of the image forming apparatus may be such that a process cartridge comprising the developing means is removably mounted in the apparatus main assembly, or that the apparatus main assembly is provided with a built-in toner hopper which can be replenished with toner with the use of a toner cartridge.

Embodiment 2

Next, referring to FIGS. 20 and 21, the second embodiment of the present invention will be described.

Incidentally, the components and portions in this embodiment, which are the same in structure and function as those in the first embodiment, will be given the same reference codes, so that the descriptions given regarding the first embodiment can be quoted.

In the above described first embodiment, the detection lever 82*b* for detecting the completion of the winding of the toner seal member 41 is kept pressed upon the regulating portion 41*e* of the doubling portion 41*b* of the toner seal member 41, by the pressure from the spring 82*c*, so that as the regulating portion 41*e*, which is preventing the rotational movement of the detection level 82*b*, is wound away as the toner seal member 41 is completely wound up by the winding shaft 42, the detecting level 82*b* is allowed to be rotated by the pressure from the spring 82*c*; in other words, the completion of the winding of the toner seal member 41 is detected.

Figure 20:
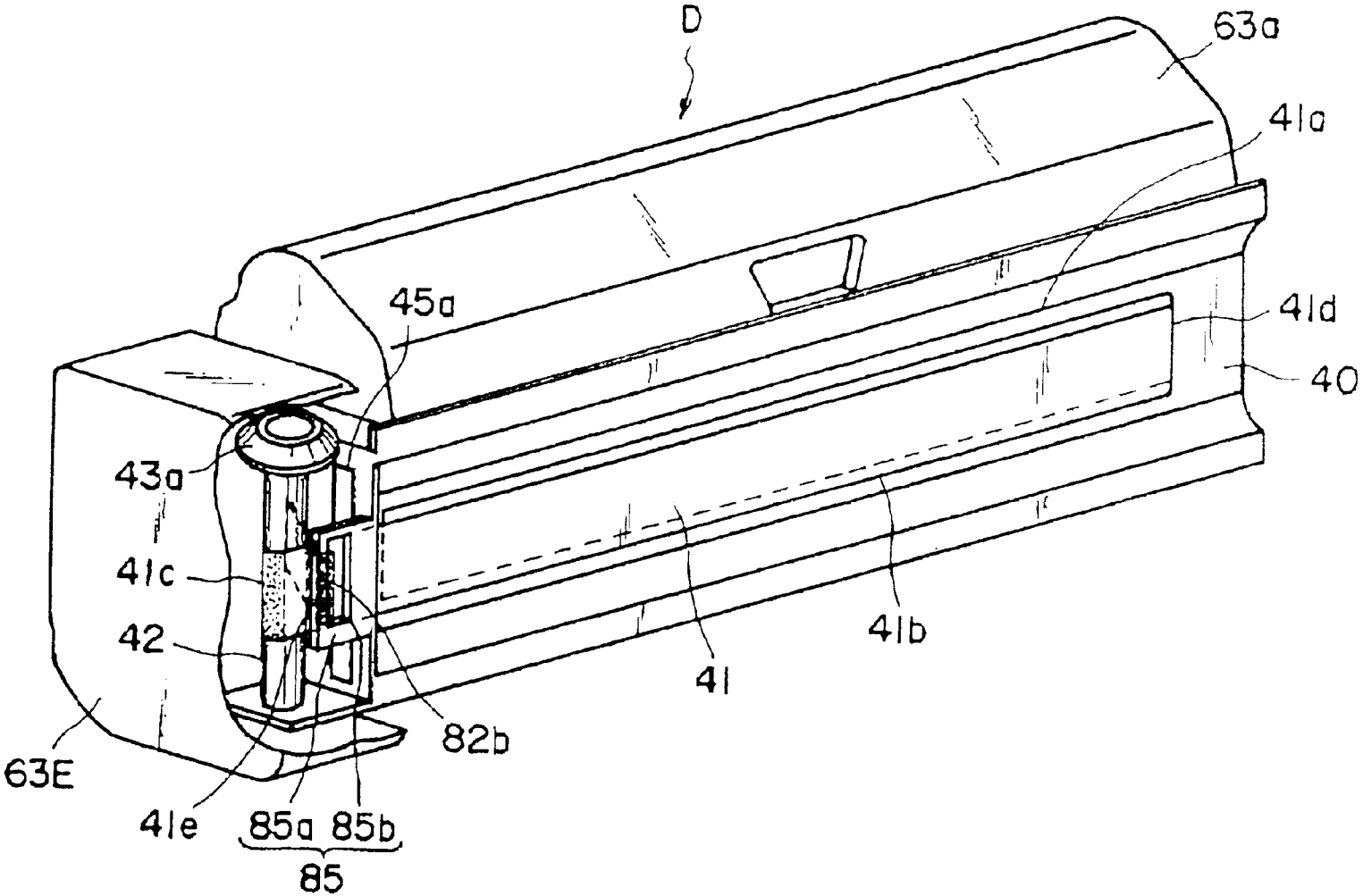
FIG. 20 is a perspective view of a toner seal member winding-up detection structure according to a further embodiment of the present invention.
Figure 21:
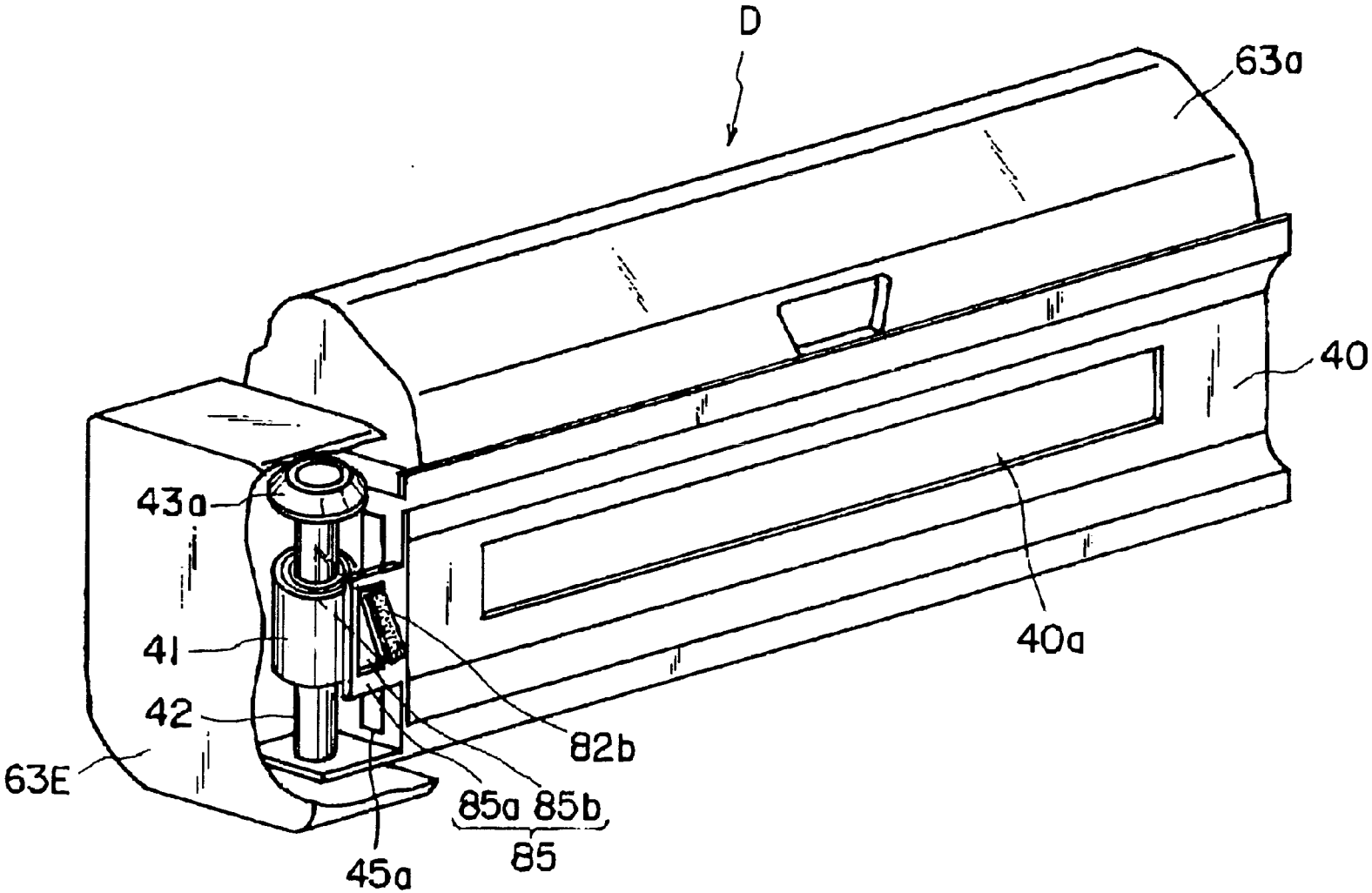
FIG. 21 is a perspective view of a toner seal winding-up detection structure according to a further embodiment of the present invention.

In comparison, referring to FIGS. 20 and 21 in this second embodiment of the present invention, the toner container portion 63*a* is provided with a backup member 85, which is formed as an integral part of the toner container portion 63*a*, and is located on the back side of the regulating portion 41*e* of the toner seal member 41 upon which the detection lever 82*b* is kept pressed by the resiliency of the spring 82*c*. The backup member 85 is provided with a surface 85*a*, the plane of which virtually coincides with that of the peelably pasted toner seal member 41. The backup member 85 is provided with a hole 85*b*, into which the detection lever 82*b* moves as the winding of the toner seal member 41 is completed.

Also in this embodiment, before the toner seal member 41 is wound away, the detection lever 82*b* is in contact with the regulating portion 41*e* of the doubling portion 41*b* of the toner seal member 41, being therefore prevented from moving (see FIG. 19). However, as the toner seal member 41 is completely wound away by the winding shaft 42, the regulating portion 41*e*, that is, the portion which prevents the movement of the detection lever 82*b*, is also wound away. As a result, the detection lever 82*b* rotates through the hole 85*b* of the backup member 85 in the direction in which the pressure is exerted upon the detection lever 82*b* by the spring 82*c*; in other words, the completion of the winding of the toner seal member 41 is detected (FIG. 21), as is in the first embodiment. The provision of the backup member 85 which supports the regulating portion 41*e* from behind, by the surface 85*a* eliminates the problem that the toner seal member 41 in the form of a flexible sheet is indented by the rigid detection lever 82*b* kept pressed upon the toner seal member 41, assuring that the completion of the winding of the toner seal member 41 is accurately detected. Further, more latitude is afforded for the amount of the pressure applied by the spring 82*c*, the selection of the material for the toner seal member, and the like.

As is evident from the above descriptions, according to the present invention a toner sealing member, which is pasted to the fringe of the developer supplying opening of a developer container to airtightly seal the opening, and is automatically wound away as a developer container, or a cartridge which has a developer container, is mounted into the image forming apparatus main assembly to expose the developer supplying opening, is provided with a sealing portion for covering the opening to airtightly seal the opening, and a regulating portion for regulating the movement of the detection member for detecting that the toner seal member has been completely wound away to expose the opening.

Further, a development cartridge, or a process cartridge which has an electrophotographic photosensitive member, to which the aforementioned toner seal member is peelably pasted, comprises: a developing means for developing a latent image formed on the electrophotographic photosensitive member; a developer container provided with an opening for supplying developer to the developing means; a winding shaft rotationally supported by the developer container for winding away the toner seal member; a driving means for rotationally driving the winding shaft; a detecting member for detecting whether or not the toner seal member has been completely wound away; and a driving force controlling means for preventing the driving means from rotationally driving the winding shaft, wherein as the completion of the winding of the toner seal member is detected, driving force controlling means is automatically activated to stop the transmission of the rotational force from the driving means.

According to an aspect of the above described structural arrangement, the toner seal member is provided with the regulating portion upon which the detection member is kept pressed, so that as the winding of the toner seal member is completed, the detection member is automatically moved to signal the completion of the winding of the toner seal member, assuring that the completion of the winding of the toner seal member is accurately detected. Further, the transmission of the driving force to the winding shaft is automatically stopped as the completion of the winding of the toner seal member is detected, and therefore, it does not occur that the driving force is transmitted to the winding shaft after the completion of the winding of the toner seal member; in other words, it does not occur that driving force is unnecessarily transmitted to the winding shaft. Consequently, the flapping of the end portion of the toner seal member 41 and/or touching of the end portion of the toner seal member 41 on the adjacencies, which causes the scattering of toner, the generation of strange noises, and the like problems, do not occur. Further, the load exerted upon the motor of the image forming apparatus main assembly 30 after the completion of the winding of the toner seal member 41 is smaller.

While the invention has been described with reference to the structures disclosed herein, it is not confined to the details set forth and this application is intended to cover such modifications or changes as may come within the purposes of the improvements or the scope of the following claims.

What is claimed is:

1. A toner seal member to be used for sealing a developer container including a developer accommodating portion for accommodating a developer; and an opening for supplying the developer from the developer accommodating portion, the toner seal member being for sealing the opening, wherein said toner seal member unseals the opening by being automatically wound up, said toner seal member comprising:

a sealing portion for covering and sealing the opening;

a regulating portion for regulating an operation of a detecting member for detecting winding up of said toner seal member to unseal the opening, wherein said regulating portion regulates an operation of the detecting member by contact of the detecting member thereto, and transmission of a winding drive force for the toner seal member is disconnected by an operation of the detecting member by release of the detecting member from the regulation of said regulating portion.

2. A toner seal member according to claim 1, wherein said regulating portion includes a fold-back portion of an extension of said sealing portion.

3. A toner seal member according to claim 2, wherein said regulating portion regulates the detecting member between the developer container and a winding shaft to which an end of said fold-back portion is fixed.

4. A development cartridge which is detachably mountable to a main assembly of an image forming apparatus, said development cartridge comprising:

developing means for developing a latent image formed on an electrophotographic photosensitive member;

a developer container having an opening for supplying a developer to said developing means;

a detecting member;

a toner seal member, affixed to seal said opening, for unsealing said opening by being automatically wound up when said development cartridge is mounted to the main assembly of the image forming apparatus, said toner seal member including a sealing portion for covering and sealing said opening and a regulating portion for regulating an operation of said detecting member for detecting winding-up of said toner seal member to unseal said opening, wherein said regulating portion regulates an operation of said detecting member by contact of said detecting member thereto;

a toner seal member winding shaft, rotatably supported on said developer container, for winding said toner seal member up;

driving means for rotating said winding shaft; and driving control means for disconnecting transmission of a driving force to said driving means by operation of said detecting member by release of said detecting member from said regulating portion.

5. A development cartridge according to claim 4, wherein said driving means receives a driving force for driving the electrophotographic photosensitive member from the main assembly of the image forming apparatus.

6. A development cartridge according to claim 4 or 5, wherein said detecting member is urged by a spring to be abutted to said regulating portion.

7. A development cartridge according to claim 4 or 5, wherein said driving control means includes a stopper for stopping rotation of said driving means in interrelation with detection of substantially complete winding-up of said toner seal member by said detecting member.

8. A process cartridge which is detachably mountable to a main assembly of an image forming apparatus, said process cartridge comprising:

an electrophotographic photosensitive member;

developing means for developing a latent image formed on said electrophotographic photosensitive member;

a detecting member;

a developer container having an opening for supplying a developer to said developing means, wherein a toner seal member is affixed to seal said opening to permit unsealing of said opening by being automatically wound up when said process cartridge is mounted to the main assembly of the image forming apparatus, the toner seal member including a sealing portion for covering and sealing said opening and a regulating portion for regulating an operation of said detecting member for detecting winding-up of the toner seal member to unseal said opening, wherein the regulating portion regulates an operation of said detecting member by contact of said detecting member thereto;

a toner seal member winding shaft, rotatably supported on said developer container, for winding the toner seal member up;

driving means for rotating said winding shaft; and driving control means for disconnecting transmission of a driving force to said driving means by operation of said detecting member by release of said detecting member from said regulating portion.

9. A process cartridge according to claim 8, wherein said driving means receives a driving force for driving said electrophotographic photosensitive member from the main assembly of the image forming apparatus.

10. A process cartridge according to claim 8 or 9, wherein said detecting member is urged by a spring to be abutted to said regulating portion.

11. A process cartridge according to claim 8 or 9, wherein said driving control means includes a stopper for stopping rotation of said driving means in interrelation with detection of substantial completion of winding-up of the toner seal member by said detecting member.

12. An electrophotographic image forming apparatus for forming an image on a recording material, to which a development cartridge is detachably mountable, said apparatus comprising:

a. mounting means for mounting the development cartridge, the development cartridge including:

developing means for developing a latent image formed on an electrophotographic photosensitive member;

a developer container having an opening for supplying a developer to the developing means;

a detecting member;

a toner seal member, affixed to seal the opening, for unsealing the opening by being automatically wound up when the development cartridge is mounted to a main assembly of said image forming apparatus, the toner seal member including a sealing portion for covering and sealing the opening and a regulating portion for regulating an operation of the detecting member for detecting winding-up of the toner seal member to unseal the opening, wherein the regulating portion regulates an operation of the detecting member by contact of the detecting member thereto;

a toner seal member winding shaft, rotatably supported on the developer container, for winding the toner seal member up;

cartridge driving means for rotating the winding shaft; and driving control means for disconnecting transmission of a driving force to the cartridge driving means by operation of the detecting member by release of the detecting member from the regulating portion;

b. feeding means for feeding the recording material; and c. apparatus driving means for driving the cartridge driving means.

13. An electrophotographic image forming apparatus for forming an image on a recording material, to which a process cartridge is detachably mountable, said apparatus comprising:

a. mounting means for mounting the process cartridge, the process cartridge including:

an electrophotographic photosensitive member;

developing means for developing a latent image formed on the electrophotographic photosensitive member;

a detecting member;

a developer container having an opening for supplying a developer to the developing means, wherein a toner seal member is affixed to seal the opening to permit unsealing of the opening by being automatically wound up when the process cartridge is mounted to a main assembly of said image forming apparatus, the toner seal member including a sealing portion for covering and sealing the opening and a regulating portion for regulating an operation of the detecting member for detecting winding-up of the toner seal member to unseal the opening, wherein the regulating portion regulates an operation of the detecting member by contact of the detecting member thereto;

a toner seal member winding shaft, rotatably supported on the developer container, for winding the toner seal member up;

cartridge driving means for rotating the winding shaft; and driving control means for disconnecting transmission of a driving force to the cartridge driving means by operation of the detecting member by release of the detecting member from the regulating portion;

b. feeding means for feeding the recording material; and c. apparatus driving means for driving the cartridge driving means.

14. A toner cartridge which is detachably mountable to a main assembly of an image forming apparatus, said toner cartridge comprising:

a developer container having an opening for supplying a developer to developing means for developing a latent image formed on an electrophotographic photosensitive member;

a detecting member;

a toner seal member, affixed to seal said opening, for unsealing said opening by being automatically wound up when said toner cartridge is mounted to the main assembly of the image forming apparatus, said toner seal member including a sealing portion for covering and sealing said opening and a regulating portion for regulating an operation of said detecting member for detecting winding-up of said toner seal member to unseal said opening, wherein said regulating portion regulates an operation of said detecting member by contact of said detecting member thereto;

a toner seal member winding shaft, rotatably supported on said developer container, for winding said toner seal member up;

driving means for rotating said winding shaft; and driving control means for disconnecting transmission of a driving force to said driving means by operation of said detecting member by release of said detecting member from said regulating portion.

15. A toner cartridge according to claim 14, wherein said driving means receives a driving force from the main assembly of the image forming apparatus.

16. A toner cartridge according to claim 14 or 15, wherein said detecting member is urged by a spring to be abutted to said regulating portion.

17. A toner cartridge according to claim 14 or 15, wherein said driving control means includes a stopper for stopping rotation of said driving means in interrelation with detection of substantial completion of winding-up of said toner seal member by said detecting member.

* * * * *

UNITED STATES PATENT AND TRADEMARK OFFICE

CERTIFICATE OF CORRECTION

PATENT NO. : 6,560,422 B2
DATED : May 6, 2003
INVENTOR(S) : Kazuhiko Kanno et al.

It is certified that error appears in the above-identified patent and that said Letters Patent is hereby corrected as shown below:

Column 6,
Line 45, "5e1." should read -- 5c1. --.

Column 10,
Line 10, "and" (1st occurrence) should be deleted.
Line 16, "partially teeth missing" should read -- partially-teeth-missing --.

Signed and Sealed this

Eighteenth Day of November, 2003

JAMES E. ROGAN
*Director of the United States Patent and Trademark Office*